US008503922B2

(12) United States Patent
Maeda et al.

(10) Patent No.: US 8,503,922 B2
(45) Date of Patent: Aug. 6, 2013

(54) DUPLEX PRINTING APPARATUS WITH VARIABLE SPEED SECTION

(75) Inventors: Yukihiro Maeda, Ibaraki-ken (JP); Masashi Hara, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 456 days.

(21) Appl. No.: 12/452,791

(22) PCT Filed: Jul. 16, 2008

(86) PCT No.: PCT/JP2008/062787

§ 371 (c)(1),
(2), (4) Date: Jan. 22, 2010

(87) PCT Pub. No.: WO2009/014033

PCT Pub. Date: Jan. 29, 2009

(65) Prior Publication Data

US 2010/0129094 A1 May 27, 2010

(30) Foreign Application Priority Data

Jul. 23, 2007 (JP) ..... P2007-191110
Apr. 9, 2008 (JP) ..... P2008-101738

(51) Int. Cl.
*G03G 15/00* (2006.01)
*G03G 15/20* (2006.01)
*B65H 5/34* (2006.01)

(52) U.S. Cl.
USPC ..... 399/396; 399/401; 399/388; 399/397; 399/68; 271/270

(58) Field of Classification Search
USPC ..... 399/401, 396, 388, 389, 391, 397, 399/68, 45; 271/270, 202, 301
See application file for complete search history.

(56) References Cited

U.S. PATENT DOCUMENTS

| | | | | |
|---|---|---|---|---|
| 4,568,169 | A * | 2/1986 | Wada et al. | 399/401 |
| 6,411,795 | B2 * | 6/2002 | Okamoto | 399/401 |
| 6,823,149 | B2 * | 11/2004 | Yoshikawa et al. | 399/68 |
| 6,895,211 | B2 * | 5/2005 | Yamashita et al. | 399/400 |
| 7,313,355 | B2 * | 12/2007 | Isobe et al. | 399/341 |
| 2002/0081120 | A1 * | 6/2002 | Oberhoffner | 399/2 |
| 2006/0239733 | A1 * | 10/2006 | Choi et al. | 399/396 |
| 2006/0263129 | A1 * | 11/2006 | Won | 399/405 |

FOREIGN PATENT DOCUMENTS

| | | |
|---|---|---|
| JP | 58-21269 A | 2/1983 |
| JP | 02-083554 A | 3/1990 |

(Continued)

OTHER PUBLICATIONS

JPO Office Action (in Japanese)—Dated Oct. 30, 2012—Filed in counterpart JP application No. 2008-101738.

*Primary Examiner* — Judy Nguyen
*Assistant Examiner* — Justin Olamit
(74) *Attorney, Agent, or Firm* — Nath, Goldberg & Meyer; Jerald L. Meyer; Scott Langford

(57) ABSTRACT

A printer is operable for image formation onto a sheet of a sheet width Lp, with a sheet spacing Lg and a printing transfer speed Vg, a constant speed transferrer makes sheet transfer at the printing transfer speed Vg from a register via the printer to a speed change position, a variable speed transferrer makes sheet transfer from the speed change position to the register, and a transfer controller controls sheet transfer speeds, the variable speed transferrer having sections for sheet transfer, including deceleration and acceleration sections for sheet reversal at the sheet reversing path, and a constant speed section for transfer at a constant transfer speed Vr, the transfer controller determining a circulating sheet number N, executing a calculation of transfer speed Vr employing sheet width Lp, sheet spacing Lg, printing transfer speed Vg, and accelerations, to enable sheet transfer for circulation within a time interval of N×(Lp+Lg)/Vg.

9 Claims, 16 Drawing Sheets

FOREIGN PATENT DOCUMENTS

| | | | |
|---|---|---|---|
| JP | 04-066028 | B2 | 10/1992 |
| JP | 07-267424 | A | 10/1995 |
| JP | 2001-282050 | A | 10/2001 |
| JP | 2002-037540 | A | 2/2002 |
| JP | 2002-221832 | A | 8/2002 |
| JP | 2005-280897 | A | 10/2005 |
| JP | 2006-248698 | A | 9/2006 |
| JP | 2007-039204 | A | 2/2007 |

* cited by examiner (a)

(b)

DUPLEX PRINTING APPARATUS WITH VARIABLE SPEED SECTION

This is a National Phase Application of PCT/JP2008/062787, filed Jul. 16, 2008 claiming priority from JP Application No.(s) P2007-191110, dated Jul. 23, 2007, and No. P2008-101738 dated Apr. 9, 2008, the entire content of which is hereby incorporated by reference.

TECHNICAL FIELD

The present invention relates to a printing apparatus, and particularly, to a duplex printing apparatus provided with a circulating transfer route including a sheet reversing path, and adapted to transfer a sheet printed on the front side in a circulating manner along the circulating transfer route, reversing from front side to rear side, permitting a printing on the rear side.

BACKGROUND ART

There are known duplex printing apparatuses provided with a circulating transfer route including a sheet reversing path, and adapted to transfer a sheet printed on the front side in a circulating manner along the circulating transfer route, reversing from front side to rear side, permitting a printing on the rear side. There is a recent desideratum for printing apparatuses to implement a high output in duplex printing.

For printing apparatuses, the output is affected mainly from an image forming speed at a printing mechanism, as well as sheet transfer speeds in a transfer mechanism of print sheets. There is a technique disclosed in the patent document 1 (Japanese Patent Application Laid-open Publication No. 2005-280897), which controls transfer speeds of sheets on the way of circulating transfer in duplex printing in accord with the sheet size, independently from a sheet transfer speed when printing, thereby permitting an enhanced output.

DISCLOSURE OF THE INVENTION

The image forming speed at the printing mechanism is determined in accordance with printing conditions such as resolution, but does not depend on whether the printing is single side or duplex. Accordingly, for printing apparatuses to be implemented with a high output in duplex printing, the image forming speed at the printing mechanism might well be set to a maximum speed determined in accordance with printing conditions for image formation.

However, for that purpose, unlike the single-side printing, the transfer mechanism of print sheets should be set up for adequate sheet transfer speeds. If the printing were single side, print sheets could have been fed one by one, permitting the printing mechanism to output as many printed sheets as it could print per unit time. In the duplex printing, print sheets printed on the front sides are transferred in a circulating manner, to be reversed for a rear side printing, so the printing apparatus's output is to be affected from a circulatory transfer speed through the transfer mechanism. In other words, in the duplex printing, if the circulatory transfer speed is set inadequate, there may come up such situations that no print sheet is being transferred despite a possible printing at the printing mechanism, disabling the printing mechanism to output printed sheets up to a potential throughput.

Such the duplex printing requires a printing process in a single-side printing to be doubled. This implies the number of output sheets per unit time in the duplex printing might well be half the number of output sheets per unit time in the single-side printing, to implement a duplex printing with the same output as an output the single-side printing could achieve in terms of an output on a one-side basis.

To achieve this output in the duplex printing, it is necessary to adjust the circulatory transfer speed as described. However, transfer speeds of sheets are not constant all the way from the feed to the discharge, i.e., through the cyclic transfer route in which print sheets are each subject to, among others, a temporary pause accompanied by deceleration and acceleration. Further, there are variations depending on printing conditions or the like, including those of the image forming speed at the printing mechanism, as well as the size of print sheets. As they vary, sheet transfer speeds also have to cope with. Such being the case, there are various factors to be considered to set up sheet transfer speeds. There is a desideratum for a setting of sheet transfer speeds with an enhanced flexibility.

The technique disclosed in the patent document 1 is a control to minimize waste of spacing between traveling sheets, but not to achieve in the duplex printing the same output as in the single-side printing on a one-side basis. Either, there is no consideration of setting sheet transfer speeds with flexibility.

The present invention has been devised in view of such issues. It therefore is an object of the present invention to provide a duplex printing apparatus adapted to set up sheet transfer speeds with an enhanced flexibility, allowing for a duplex printing with an output equivalent, in terms of an output sheet number per unit time in a normal state, to half an output sheet number in a single-side printing. As used herein, the normal state refers to an interval of time in which a front side and a rear side are alternated to print, excluding the intervals at the initiation and the end of the duplex printing in which a front side and a rear side are consecutively printed.

To achieve the object, according to an aspect of the present invention, a duplex printing apparatus is provided with a circulating transfer route including a sheet reversing path, and configured to transfer a sheet printed on a front side thereof in a circulating manner along the circulating transfer route, reversing front to rear, to make a print on a rear side thereof, the duplex printing apparatus comprising a printer adapted for image formation onto a sheet of a sheet width Lp in a transfer direction, with a sheet spacing Lg and a printing transfer speed Vg, a constant speed transferrer adapted for constant speed transfer of sheet at the printing transfer speed Vg from a register for sheet registration via the printer to a prescribed speed change position in the circulating transfer route, a variable speed transferrer adapted for transfer of sheet from the speed change position via the sheet reversing path to the register, and a transfer controller configured to control transfer speeds of sheet in the variable speed transferrer, the variable speed transferrer comprising sections configured for sheet transfer, including a combination of a deceleration section and an acceleration section adapted for sheet reversal at the sheet reversing path, and a constant speed section adapted for transfer at a transfer speed Vr, the transfer controller being adapted to determine a circulating sheet number N defining a printing order in a duplex printing, and execute a calculation of transfer speed Vr employing a combination of sheet width Lp, sheet spacing Lg, printing transfer speed Vg, and accelerations to be applied at the deceleration section and the acceleration section, to transfer a sheet from the register in the circulating manner to the register within a time interval of $N\times(Lp+Lg)/Vg$.

BEST MODE FOR CARRYING OUT THE INVENTION

There will be described embodiments of the present invention with reference to the drawings.

1. Configuration of Printing Apparatus

Figure 1:
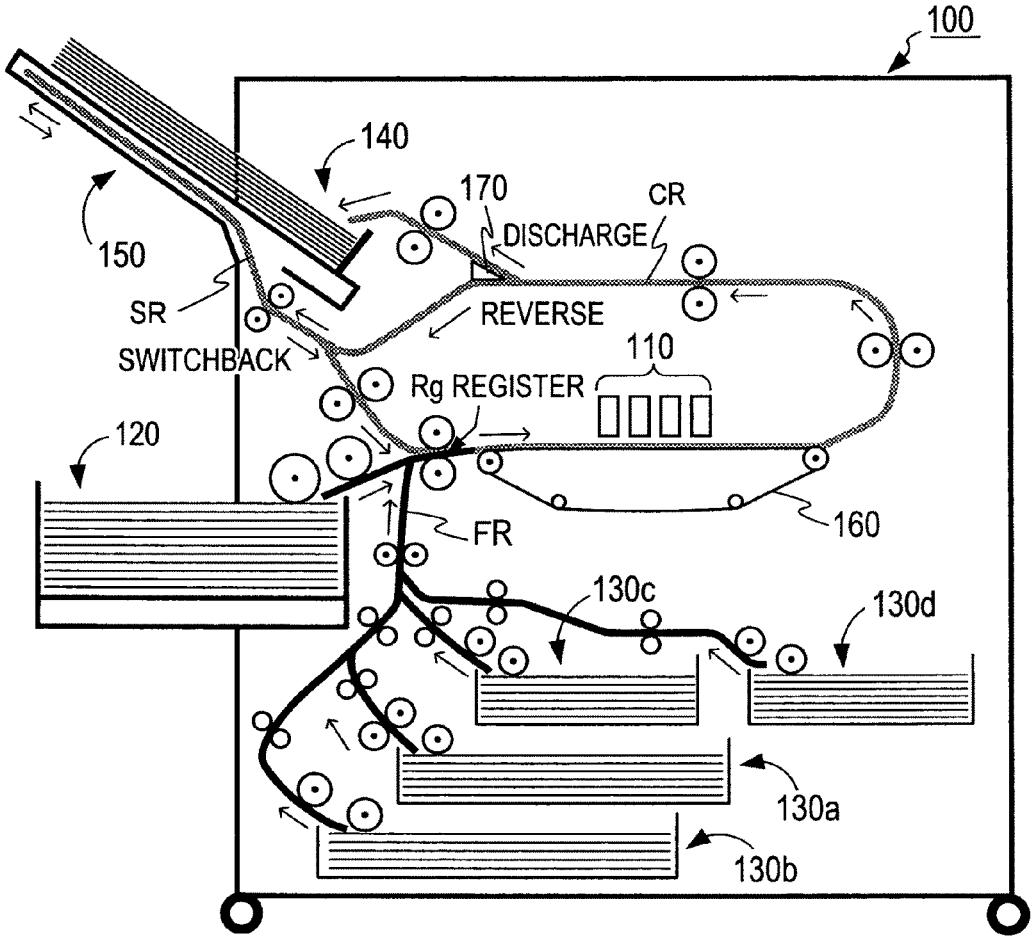
FIG. 1 is a general illustration of print sheet transfer routes of a printing apparatus according to the present invention.

FIG. 1 is a general illustration of print sheet transfer mutes of a printing apparatus 100 including a circulating transfer route according to the present invention. As illustrated in the figure, the printing apparatus 100 has, as a set of sheet feeding mechanisms for supplying print sheets, a combination of a plurality of feed trays (130*a*, 130*b*, 130*c*, and 130*d*) incorporated in a machine housing, and a side feed rack 120 exposed outside at a lateral side of the housing. Further, it has a discharge port 140 as a sheet discharging mechanism for discharging printed print sheets. It is noted that print sheets are not restricted to paper, and may be other materials such as a synthetic resin.

The printing apparatus 100 is a line color printer of inkjet type for a printing by lines. The line color printer of inkjet type has as a printing mechanism a print head unit 110 including a plurality of print heads arranged to extend in a direction perpendicular to a sheet transfer direction, and each formed with multiple nozzles. The print heads are each respectively operable to propel black or color ink for printing. It however is noted that the present invention is not restricted to this system, and applicable to printing apparatuses of other printing systems. For instance, it may be a printing apparatus of a serial inkjet system, laser system, or such. Further, the present invention is applicable to printing apparatuses implementing printing processes including not simply a printing based on transmitted data from a host computer, but also a copy printing, facsimile printing, etc.

Print sheets are to be supplied one by one from any one of feed mechanisms being the side feed rack 120 and feed trays 130, and transferred by a drive mechanism composed of drives such as those having rollers, along a feeding transfer route FR (defined later on), to be lead to a register Rg. The register Rg is configured with a pair of register rollers for registration at a leading edge of print sheet, and correction of oblique sheet position. Each fed print sheet is put to a temporary pause at the register Rg, and transferred to the print head unit 110 at a prescribed timing.

At the print head unit 110, the print sheet transferred thereto is vacuum-sucked by a looped transfer belt 160 facing the print head unit 110, and transferred at a speed determined in accordance with printing conditions, having images formed thereon by lines by droplets of ink propelled from print heads.

The print sheet thus printed is further transferred by a drive mechanism. For single-side printing, the print sheet is guided directly to the sheet discharge port 140, where it is discharged to stack, with a printed side down, on a discharge rack 150 provided as a sheet receiver at the sheet discharge port 140. The discharge rack 150 is set in the form of a tray protruding from the machine housing, with a thickness as necessary. The discharge rack 150 is inclined, so the print sheet once discharged from the sheet discharge port 140 is slid down along the inclination to a wall formed at a lower position of the inclination, whereby it is trimmed to pile up in due course.

For duplex printing, the print sheet has a print made on the front side (assuming "a front side" thereof as the side to be printed first, and "a rear side" thereof as the side to be printed next), and after completion of the printing, it is further transferred inside the machine housing, without being guided to the sheet discharge port 140. For this purpose, the printing apparatus 100 is provided with a selecting mechanism 170 to select a sheet transfer route for rear side printing. By this selecting mechanism 170, the print sheet is pulled into a switchback path SR, where it is switched back, with a resultant front-to-rear inversion with respect to the transfer route. Then, the print sheet is guided by a chive mechanism again to the register Rg, where it is put to a temporary pause. Afterwards, the print sheet is transferred at a prescribed timing to the print head unit 110, where the rear side is printed in the same manner as the front side. With the rear side printed, the print sheet now image-formed on both sides is guided to the sheet discharge port 140, where it is discharged to stack on the discharge rack 150 provided as a receiver rack at the discharge port 140.

At the printing apparatus 100, an internal space of the discharge rack 150 is availed to implement a switch back for duplex printing. The space in the discharge rack 150 is enclosed as a configuration to keep a print sheet or print sheets from being taken from outside in the course of switchback. This prevents such a print sheet or print sheets from being pulled out by a mistake of user in the course of switchback. The discharge rack 150 is provided as an inherent member to the printing apparatus 100, permitting use of an internal space of the discharge rack 150 for switchback, thus affording to eliminate provision of an extra space for switchback in the printing apparatus 100. This permits the machine housing to be kept from being enlarged in size. Further, there is no sharing between discharge port and switchback path, which affords parallel operations for a switchback process and discharge of any print sheet else.

In the printing apparatus 100, the register Rg sets up a reference position of a leading end of print sheet, whereto also a print sheet printed on the front side is transferred in duplex printing. Accordingly, at a location just before the register Rg, there is a confluence junction between a path for transfer of a print sheet fed from any sheet feed mechanism and a path for transfer of a print sheet printed on the front side on the way of circulation. This junction constitutes a reference to define any path on the sheet feeding side as a feeding transfer route FR, the set of paths else being referred to as a circulating transfer route CR. The switchback path SR is deemed as part of the circulating transfer route CR.

Figure 2:
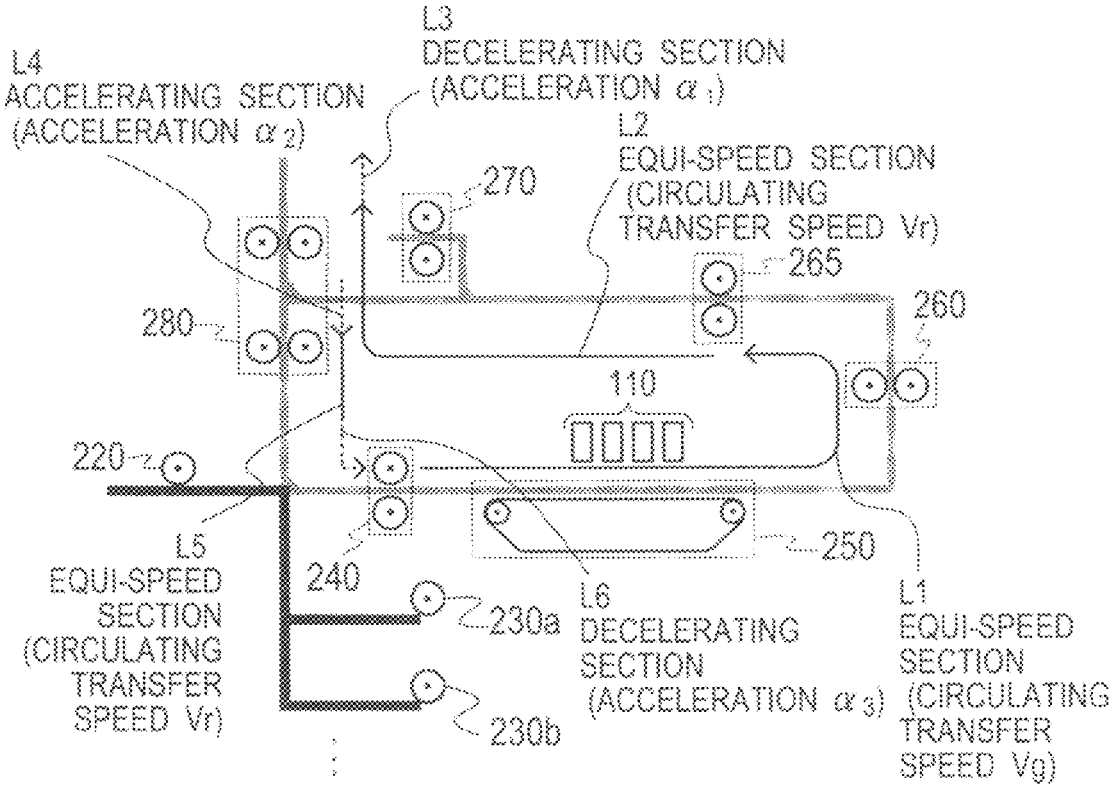
FIG. 2 is a schematic diagram of sheet feeding transfer routes and a cyclic transfer route.

FIG. 2 is a schematic diagram of a system of feeding transfer routes FR and the circulating transfer mute CR. Numbers of rollers constituting respective drives are eliminated as necessary for simplicity. The system of feeding transfer routes FR includes a side feed drive 220 configured to feed a sheet from the side feed rack 120, and a system of tray-1 drive 230*a*, tray-2 drive 230*b*, and so on each configured to feed a sheet from a feed tray (130*a*, 130, b, 130*c*, and 130*d*). Those drives are each operable to take up a sheet one by one from a stack of print sheets in the side feed rack or any feed tray, to transfer to the register R. The drives can be driven in an independent manner, permitting necessary drives to work in accordance with a feed mechanism feeding a sheet.

The circulating transfer route CR is configured with a register drive 240 including register rollers, a belt drive 250 for driving the transfer belt 160 facing the print head unit 110, a combination of a first top transfer drive 260 and a second top transfer drive 265 arranged in this order in the sheet transfer direction, a top discharge drive 270 for guiding a printed print sheet to the discharge port 140, and a switchback path drive 280 for pulling a print sheet into the switchback path SR, to reverse, to guide to the congruent junction, for rear side printing. Those drives can be driven in an independent manner, permitting necessary drives to work in accordance with a transfer condition of print sheet.

The printing apparatus 100 is operable not simply to feed a print sheet after a previous fed print sheet is printed and discharged, but also to feed a print sheet before discharge of a print sheet or print sheets previously fed, for a consecutive printing with a specified spacing. Accordingly, in the consecutive printing, the printing apparatus 100 has a plurality of print sheets residing in the circulating transfer mute CR. The number of print sheets being transferred for circulation in the circulating transfer mute CR is now defined as a circulating sheet number N. It however is noted that the circulating sheet number N does not always define the number of print sheets simultaneously residing in transfer paths, but does define the order of printing of a front side and a rear side in a schedule for duplex printing, as will be described later. For instance, for a circulating sheet number N, in a normal state after a certain print sheet is printed on the front side, there comes a sequence of other N−1 print sheets to be printed before printing the rear side of that print sheet.

The system of feeding transfer routes FR as well as the circulating transfer route CR has unshown sheet sensors arranged in positions to detect presence or absence of print sheet, checking for feed errors, transfer jams, discharge errors, etc.

Figure 3:
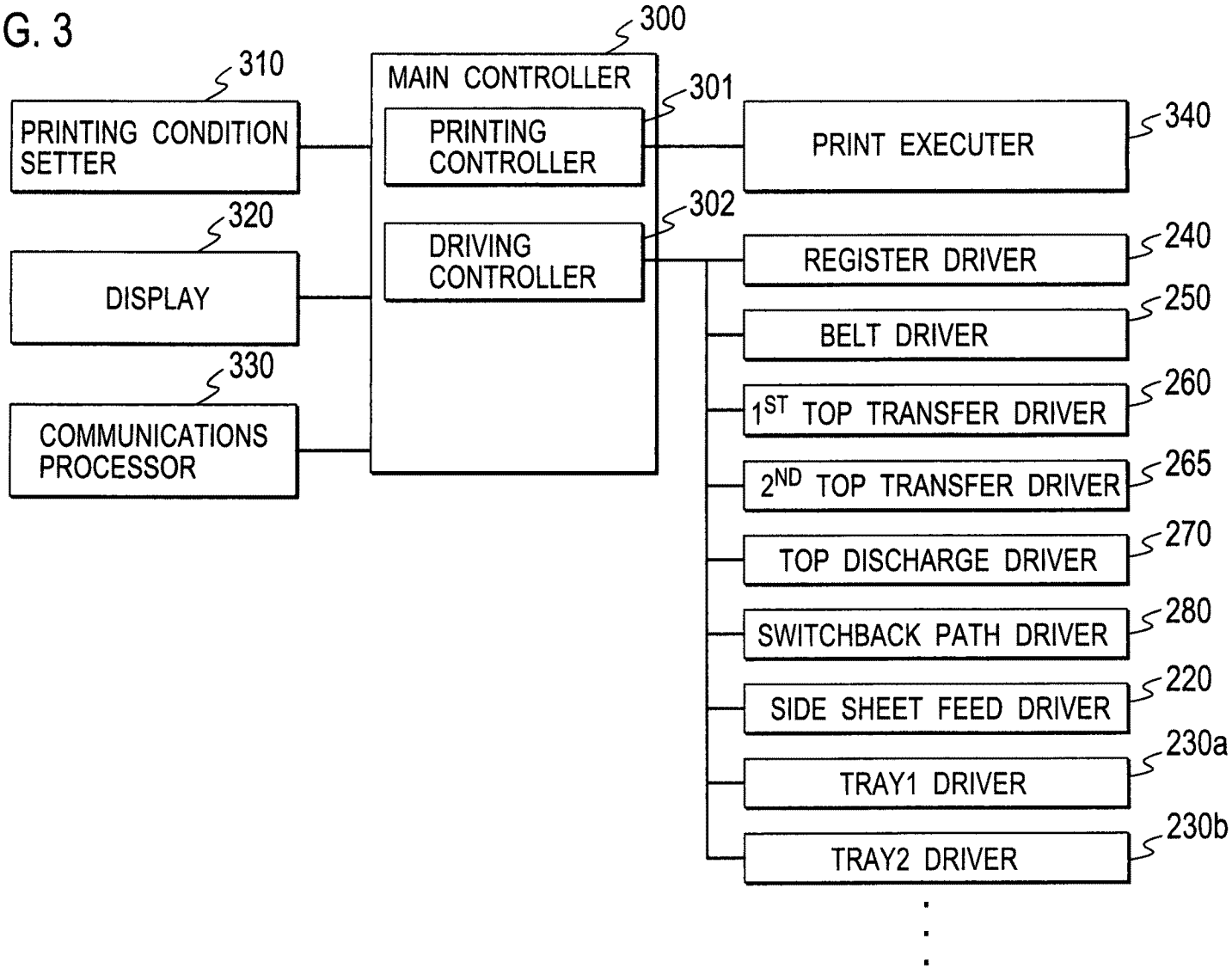
FIG. 3 is a block diagram of functional configuration of the printing apparatus.

FIG. 3 is a block diagram of functional configuration of the printing apparatus 100. The printing apparatus 100 includes a main controller composed of a CPU, memories, etc. And, the main controller 300 includes a printing controller 301, and a driving controller 302. The printing controller 301 and the driving controller 302 operate on programs stored in a memory, to control the printing mechanism and the driving mechanism, respectively.

Further, the printing apparatus 100 includes a printing condition setter 310 for receiving settings of printing conditions such as on single-side or duplex printing, print sheet size, resolution, etc, a display 320 for displaying information concerning the printing apparatus 100, and a communications processor 330 configured for connections with computer networks and the like. The printing condition setter 310 is adapted for reception of e.g. a printing condition according to an instruction of user through an unshown input panel, as well as print data sent from a computer connected via computer network.

The printing controller 301 is configured to work in accordance with printing conditions accepted at the printing condition setter 310, to generate frames of image data, and control execution of printing processes at a printing executor 340 constituted with the printing mechanism. The driving controller 302 is configured to work under control of the printing controller 301, to operate above-described drives, to transfer print sheets. Further, the driving controller 302 is adapted to implement later-described processes such as calculation of print sheet transfer speeds, and determination of the circulating sheet number of print sheets.

2. Transfer of Print Sheets

Print sheets are not transferred at a constant speed through the circulating transfer route CR that has, as illustrated in FIG. 2, sections for equi-speed transfer, and sections for deceleration and acceleration. This configuration enables the printing mechanism to exhibit a sufficient performance to implement a duplex printing with the same output as the single-side printing on the one-side basis. On a one-sheet basis, the output of duplex printing becomes half the output of single-side printing. For transfer routes in this figure, corresponding arrows are depicted for reference at the position of a leading edge in transfer direction of print sheet.

On the way from the register drive 240 to the second top transfer drive 265, the image formation to be performed by propelling ink requires a speed to be kept constant, and each print sheet is transferred at a constant speed that is a printing transfer speed Vg. The printing transfer speed Vg is a speed required for image formation by propelling ink from the print head unit 110, and determined depending on printing conditions such as a maximal number of ink droplets per pixel, and resolution.

Therefore, once the printing conditions are established, the a printing transfer speed Vg can have a maximal value thereof uniquely determined in accordance with a performance of the printing mechanism, in particular of an ink propelling mechanism of print head, properties of ink, and the like, irrespective of whether the printing is single side or duplex. In this embodiment, in order for the performance of printing mechanism to be sufficiently exhibited, print sheets are to be transferred at a highest speed the printing mechanism permits, which transfer speed is the printing transfer speed Vg. It however is noted that the printing transfer speed Vg is not always required to be a physically highest speed, and may be a practically highest speed in consideration of a given margin and the like. There is a section for equi-speed transfer at the printing transfer speed Vg, which is referred to as a constant speed section L1. The constant speed section L1 has a fixed length equivalent to the distance from register rollers of the register drive 240 to drive rollers of the second top transfer drive 265.

Past the second top transfer drive 265 the way is subject to an equi-speed transfer at a circulatory transfer speed Vr determined by a later-described process. This circulatory transfer speed Vr is set to be the printing transfer speed Vg or more, to avoid collision of between print sheets in the circulating transfer route CR. There is a section for equi-speed transfer at the circulatory transfer speed Vr, which is referred to as a constant speed section L2. The first top transfer drive 260's drive rollers and the second top transfer drive 265's drive rollers are individually controlled to have their revolution speeds, and when a leading end of a print sheet has reached the second top transfer drive 265's drive rollers, the print sheet is subject to an instantaneous speed change from the printing transfer speed Vg to the circulatory transfer speed Yr.

At this moment, the first top transfer drive 260's drive rollers have a revolution speed synchronized with a revolution speed of the second top transfer drive 265's drive rollers. In this regard, the first top transfer drive 260's drive rollers are configured with a one-way clutch structure with respect to the sheet transfer direction, to prevent a motor of the first top transfer drive 260 from being loaded, while preventing back tensions due to the speed change, permitting a prompt speed shift of print sheet.

In due course, the print sheet is put to a pause to provide for a switchback action. If the print sheet were stopped instantaneously, the switchback path drive 280 would have an increased load, so the print sheet is decelerated by a constant acceleration from the speed Vr to a zero speed. This is done within a section referred to as a decelerating section L3. It is noted that the print sheet is required to sop in position for ensured engagement of its end with rollers, which depends on the size of sheet. Accordingly, the decelerating section L3 is variable in length. In correspondence thereto, also the constant speed section L2 is varied in length. The acceleration at the decelerating section L3 is designated by $\alpha 1$.

After that, the print sheet is accelerated in opposite direction from a zero speed to the circulatory transfer speed Yr. As the traveling direction of print sheet is reversed, the print sheet has a reference position at its end opposite before the reverse, i.e., at the trailing end. In this case also, to prevent the switchback path drive 280 from being loaded, the circulatory transfer speed is not instantaneously changed. The print sheet is accelerated by a constant acceleration. This is done within a section referred to as an accelerating section L4. The acceleration at the decelerating section L4 is defined by a magnitude $\alpha 2$.

The print sheet is accelerated up to a circulatory transfer speed Vr, to enter again into an equi-speed transfer at the circulatory transfer speed Vr. The print sheet is subject to the equi-speed transfer at the circulatory transfer speed Vr, within a section referred to as a constant speed section L5. After that, the print sheet is decelerated from the speed Vr to a zero speed, to put to a pause at the register Rg. In this case also, to prevent the switchback path drive 280 from being loaded, the print sheet is not instantaneously stopped, but it is decelerated by a constant acceleration. This is done within a section referred to as a decelerating section L6. The acceleration at the decelerating section L6 is designated by $\alpha 3$.

The accelerations $\alpha 1$, $\alpha 2$, and $\alpha 3$ are now assumed as being fixed in value, to avoid complexity in control processes. It also is assumed that $|\alpha 1|=|\alpha 2|=|\alpha 3|(=|\alpha|)$ for simplicity. The circulatory transfer speed Vr of print sheet, adjustable with ease, is taken as a target of control in this embodiment, with an intention to make the printing mechanism exhibit a sufficient performance in duplex printing, as well. This enables reduction of process loads in circulating transfer. It however is noted that the acceleration a may be changed in accordance with associated conditions, and the accelerations $\alpha 1$, $\alpha 2$, and $\alpha 3$ may have different magnitudes.

Referring now to FIGS. 4 to 6 and FIG. 7, detailed description will be made of processes for transfer on the circulating transfer route CR for duplex printing of a print sheet P. The print sheet P is assumed as having a width Lp in the transfer direction. Further, it is supposed that the sheet is fed from the side feed rack 120, and feed trays 130 are omitted.

Figure 4:
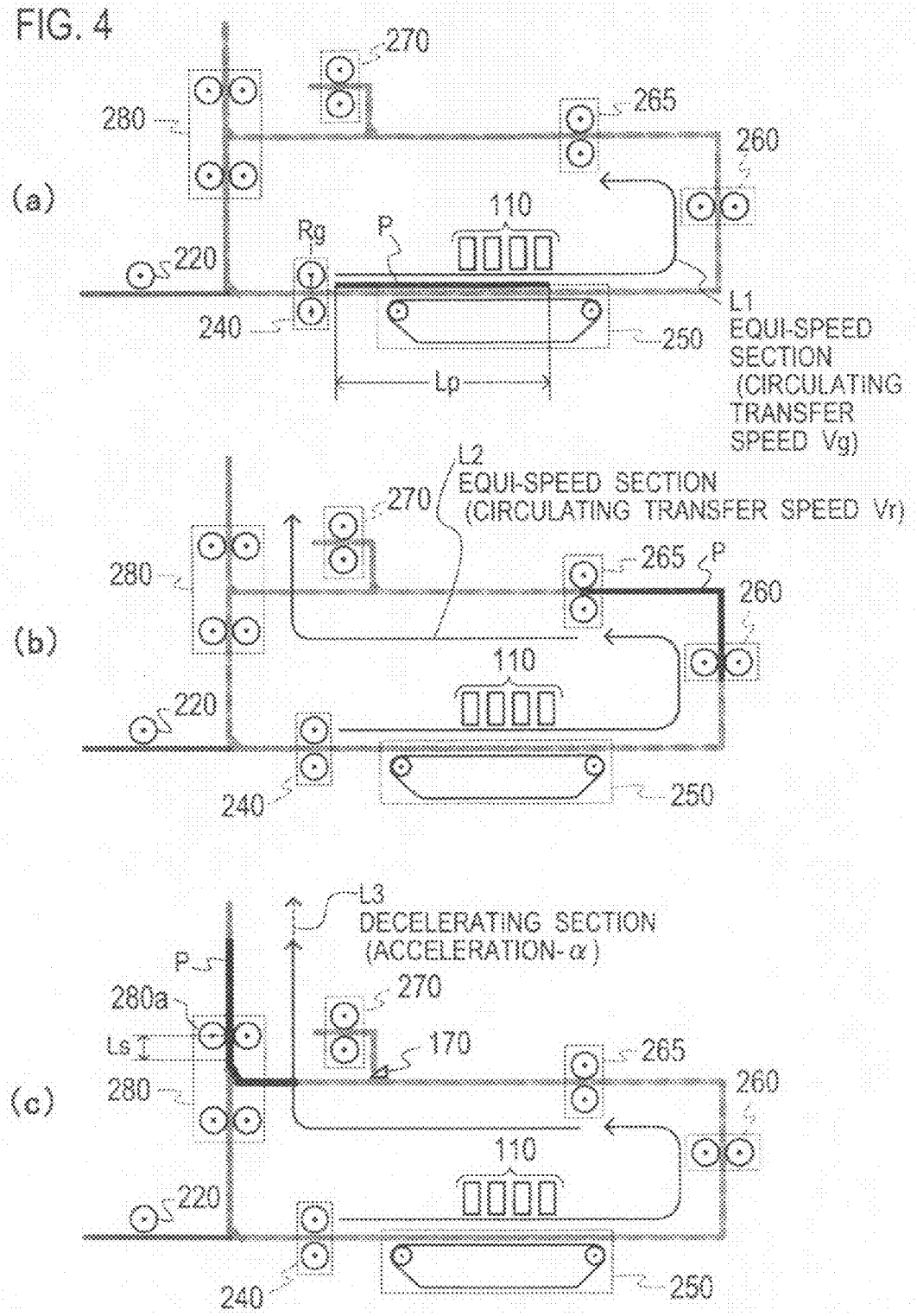
FIGS. 4(*a*) to (*c*) are detail explanatory diagrams of a circulating transfer mute CR with a print sheet P in transfer processes for duplex printing.

The print sheet P, as fed from the side feed rack 120 by the side feed drive 220, has been put to a temporary pause at the register Rg, where it is drawn at a prescribed timing by the register drive 240 with register rollers, into a state illustrated in FIG. 4(*a*), where it is moved by an equi-speed transfer by the belt drive 250 at a printing transfer speed Vg, while being printed on the front side by the print head unit 110. Afterward, the print sheet P is moved by an equi-speed transfer still at the printing transfer speed Vg by the first top transfer drive 260's drive rollers.

As illustrated in FIG. 4(*b*), a leading end of print sheet P arrives at the second top transfer drive 265's drive rollers, which causes a shift of transfer to a transfer of print sheet P at a circulatory transfer speed Vr determined by a later-described process. At a time point before arrival of the leading end of print sheet P at the second top transfer drive 265's drive rollers, there was a combination of the first top transfer drive 260's drive rollers rotating at the printing transfer speed Vg and the second top transfer drive 265's drive rollers rotating at the circulatory transfer speed Yr. The first top transfer drive 260's drive rollers have a one-way clutch structure as described, and after the leading end of print sheet P has arrived at the second top transfer drive 265's drive rollers, the first top transfer drive 260's drive rollers are caused to rotate at the printing transfer speed Vg. It is noted that the print head unit 110 should have its printing completed until the leading end of print sheet P arrives at the second top transfer drive 265's drive rollers, or before the transfer speed changes. Therefore, the second top transfer drive 265's drive rollers are spaced from the print head unit 110 at a distance designed greater than a transfer-directional width Lp of a print sheet of a maximal size certified at the printing apparatus 100.

In due course, the print sheet P is guided by the selecting mechanism 170 toward the switchback path SR, and as illustrated in FIG. 4(*c*), decelerated in the decelerating section L3, to put the print sheet P to a pause for a switchback. At this timing, the print sheet P is controlled to have its trailing end stopped in position at a distance Ls (as a trailing end margin for reverse) in the post-reverse traveling direction from drive rollers 280*a* the switchback path drive 280 has at the outermost end in the ante-reverse traveling direction.

The trailing end margin Ls for reverse is preset as a distance to afford the print sheet P to be drawn enough inside the switchback path SR so as to be reversible, allowing the print sheet P to move in both directions without disengagement from the drive rollers 280*a*. Accordingly, the decelerating section L3 is initiated at a location that permits the trailing end of print sheet P to stop in position at the distance Ls from the drive rollers 280*a*, when the print sheet P is decelerated at an acceleration a from the circulatory transfer speed Vr. The trailing end margin Ls for reverse has a fixed value in this embodiment, but may well be changed in accordance with associated conditions.

Figure 5:
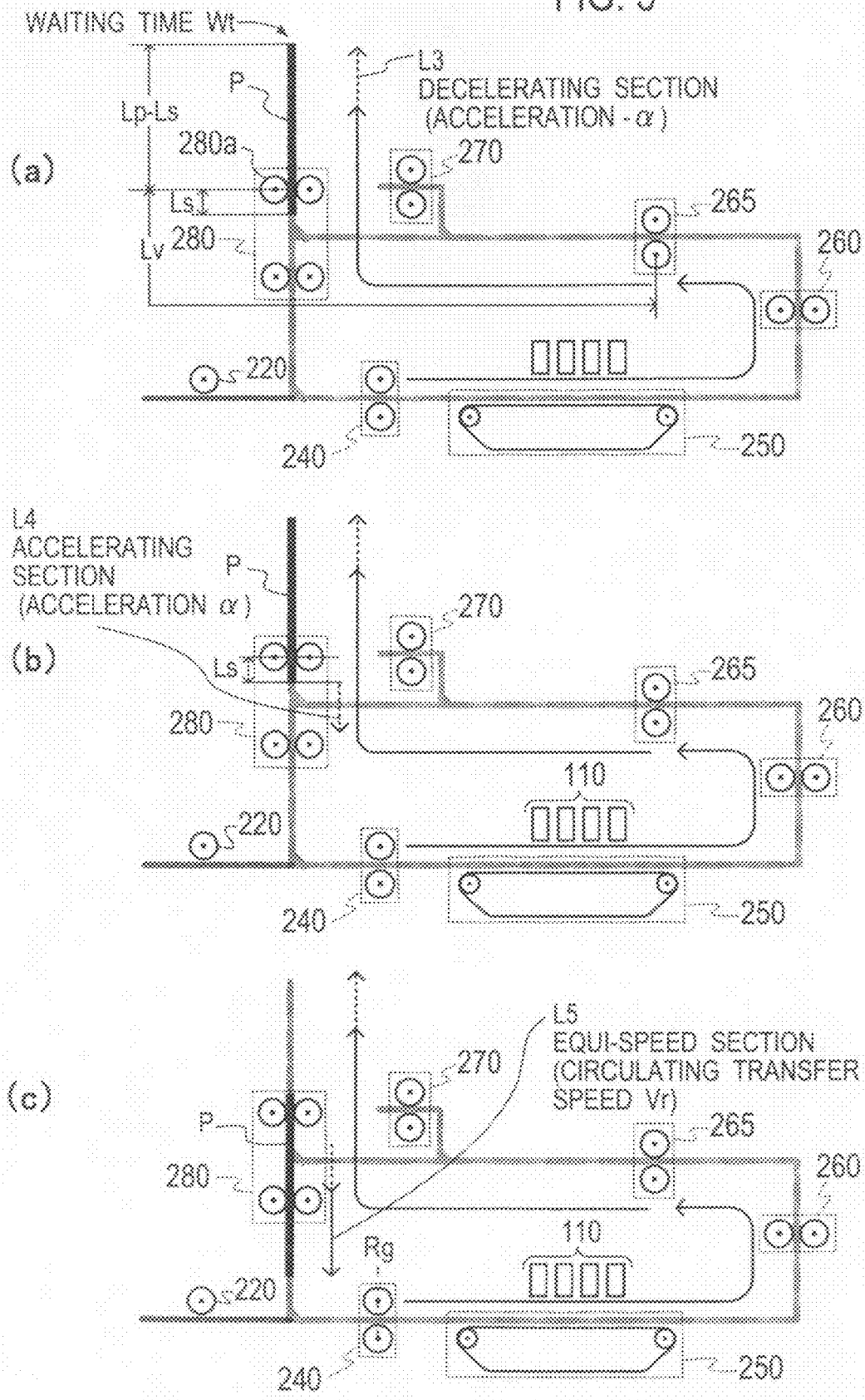
FIGS. 5(*a*) to (*c*) are detail explanatory diagrams of the circulating transfer route CR with the print sheet P in transfer processes for duplex printing.

As illustrated in FIG. 5(*a*), the trailing end of print sheet P stops in position at the distance Ls from the drive rollers 280*a*, when the print sheet P is switched back to transfer in opposite direction. The drive rollers 280*a* need a minute time Wt to start rotation after they have stopped, so the print sheet P is held in a pause for a prescribed time Wt. During the pause, the print sheet P has its leading end in position spaced at Lp–Ls from the drive rollers 280*a*. Designated at Lv is a distance from the second top transfer drive 265's drive rollers to the switchback path drive 280's drive rollers 280*a*. The above-noted time Wt is prescribed as a fixed value in this embodiment, but may well be changed in accordance with associated conditions.

As illustrated in FIG. 5(*b*), after initiation of the reverse, the print sheet P is accelerated by an acceleration α up to a circulatory transfer speed Vr. When accelerated to the circulatory transfer speed Vr, as illustrated in FIG. 5(*c*), the print sheet P is subject to an equi-speed transfer at the circulatory transfer speed Vr.

Figure 6:
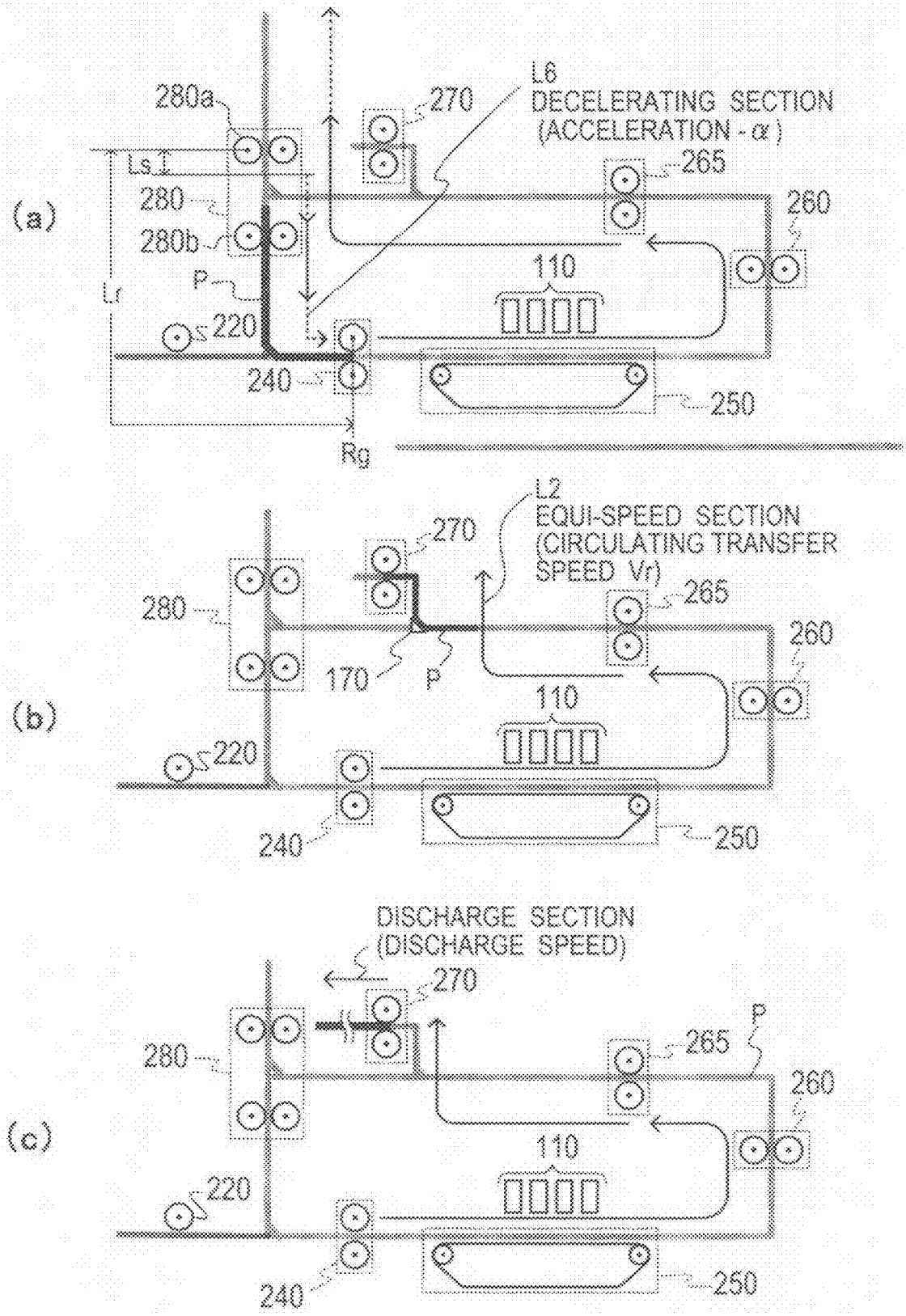
FIGS. 6(*a*) to (*c*) are detail explanatory diagrams of the circulating transfer route CR with the print sheet P in transfer processes for duplex printing.
Figure 7:
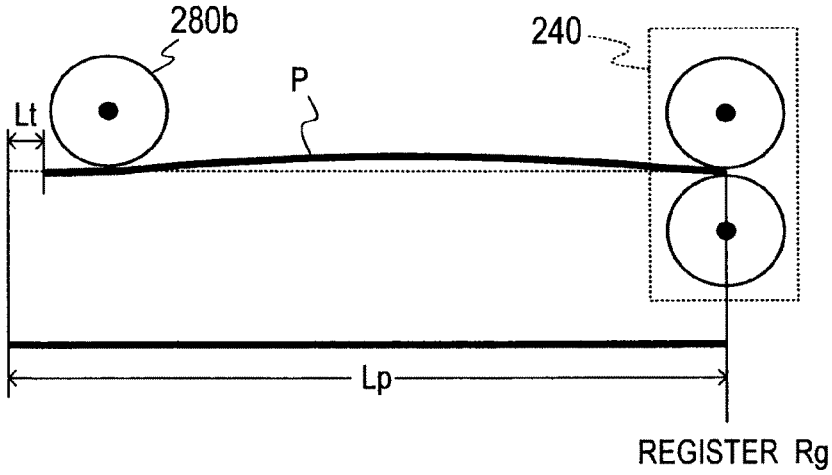
FIG. 7 is an explanatory diagram of a print sheet with an amount of slack.

In due course, as illustrated in FIG. 6(*a*), the print sheet P is decelerated in the decelerating section L6, to stop the print sheet P at the register Rg. Accordingly, the decelerating section L6 is initiated at a location that permits the trailing end of print sheet P to stop in position at the register Rg, when the print sheet P is decelerated at an acceleration a from the circulatory transfer speed Vr. In this respect, at the register Rg, as illustrated in FIG. 7, the print sheet P is put to a pause with a slack for correction of an oblique sheet position. It is noted that actually the transfer route is curved, unlike the figure illustrating a straight path for comprehension with ease. As illustrated in the figure, the switchback path drive 280's drive rollers 280*b* at the register Rg side are adapted to transfer the print sheet P by a feed over the print sheet's length Lp, so the print sheet P slacks. This slack Lt is preset to an optimal value. Referring again to FIG. 6(*a*), designated at Lr is a distance from the switchback path drive 280's drive rollers 280*b* to the register Rg. The slack Lt is a fixed value in this embodiment, but may well be changed in accordance with associated conditions.

After that, the print sheet P is pulled forth by the register drive 240's register rollers, into a state illustrated in FIG. 4(*a*), where it is moved by an equi-speed transfer by the belt drive 250 at a printing transfer speed Vg, while being printed on the rear side by the print head unit 110. Afterward, the print sheet P is moved by an equi-speed transfer still at the printing transfer speed Vg by the first top transfer drive 260's drive rollers.

After the rear side printing, as illustrated in FIG. 6(*b*), the print sheet P is guided by the selecting mechanism 170 toward the discharge port 140, and as illustrated in FIG. 6(*c*), discharged by the top discharge drive 270 at an adequate speed for discharge.

Figure 8:
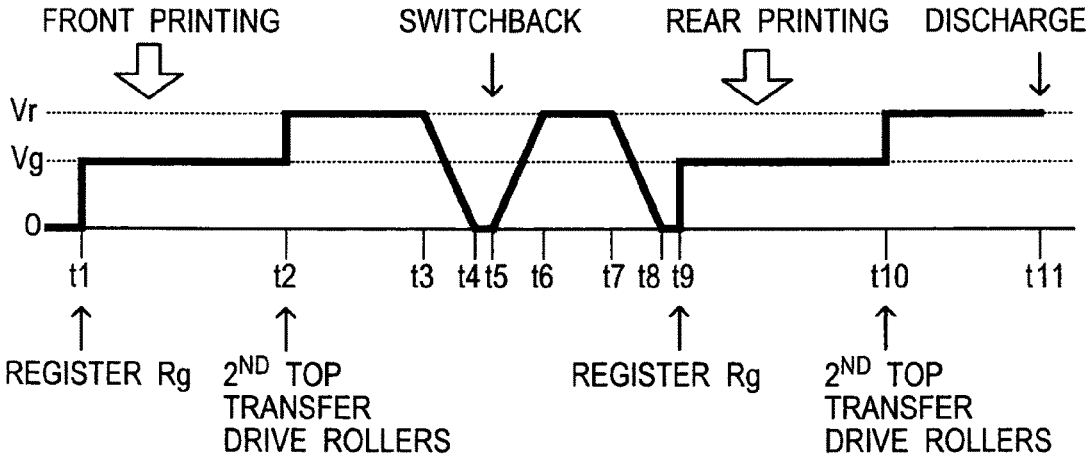
FIG. 8 is a chart of a varying transfer speed of print sheet for duplex printing.

The print sheet P is thus subject to transfer speeds changed through the foregoing transfer processes as illustrated in FIG. 8. Namely, the print sheet P is subjected, from a time t1, to a constant speed transfer from the register Rg at a printing transfer speed Vg, where it is printed on the front side, and from a time t2 when it arrives at the second top transfer drive 265's drive rollers, to a constant speed transfer at a circulatory transfer speed Vr. Then, the print sheet P is decelerated, from a time t3 to a time t4, by an acceleration a down to a zero speed, and is put to a pause for a prescribed time interval Wt from the time t4 to a time t5. Next, the print sheet P is switched back, and is accelerated, from the time t5 to a time t6, by an acceleration a up to the circulatory transfer speed Vr, and subjected, till a time t7, to a constant speed transfer at the circulatory transfer speed Vr. Next, the print sheet P is decelerated, from the time t7, by an acceleration α, returning to the register Rg at a time t8 for a temporary pause. Then, the print sheet P is subjected, from a time t9, to a constant speed transfer from the register Rg at the printing transfer speed Vg, where it is printed on the rear side, and from a time t10 when it arrives at the second top transfer drive 265's drive rollers, to a transfer at the circulatory transfer speed Vr; to be discharge at a time t 11.

It is noted that in the foregoing description with reference made to FIG. 4 to FIG. 6, there has been a single print sheet focused to detail transfer processes for duplex printing, whereas the printing apparatus 100 is adapted to work, before discharging a preceding print sheet, to feed a subsequent print sheet, permitting a plurality of print sheets to be concurrently subject to the described courses of transfer for circulation.

Figure 9:
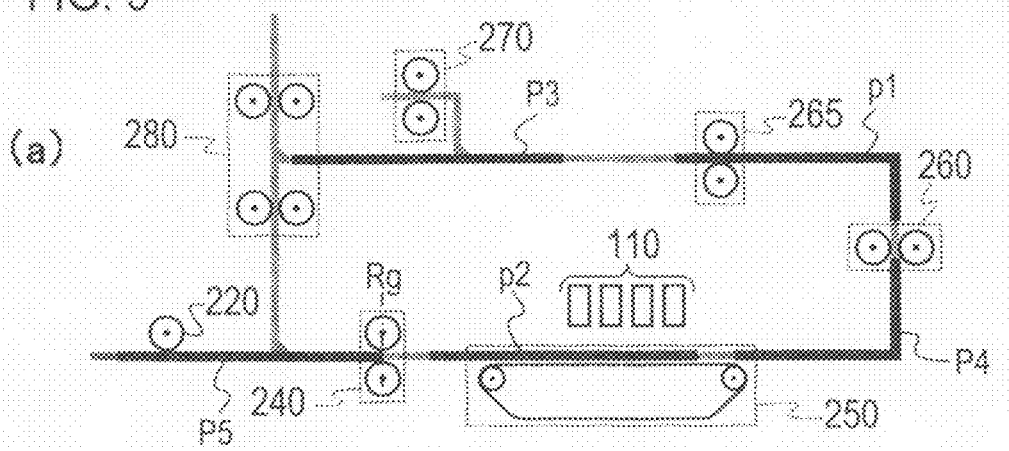
FIGS. 9(*a*) and (*b*) are diagrams of states of print sheet transfer, for a number of simultaneously circulative print sheets set to five.
Figure 9:
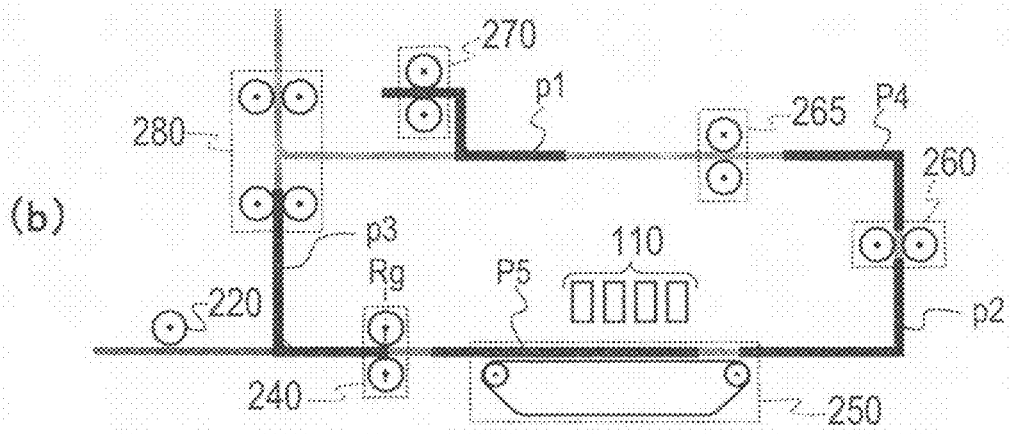

FIG. 9 is a diagram showing a transfer state of print sheets for N=5, that is, assuming 5 as the number of circulating print sheets in the circulating transfer route CR, in FIG. 9(*a*) illustrating a fifth print sheet P5 when the feed is initiated, and in FIG. 9(*b*) illustrating the fifth print sheet P5 when the feed is completed. In these figures, designated at small letters p are print sheets before rear side printing, and large letters P are prints sheets after rear side printing.

In FIG. 9(*a*), the fifth print sheet P5 in a state to be fed follows a print sheet p2 being subjected after a printing on the rear side to a transfer at a printing transfer speed Vg, which still follows a fourth print sheet P4 being subjected before a printing on the rear side to a transfer at the printing transfer speed Vg. This print sheet P4 follows a first print sheet p1 being subjected after a print on the rear side to a transfer at a circulatory transfer speed Vr, which yet follows a third print sheet P3 being subjected after a printing on the front side to a transfer for switchback.

In FIG. 9(*b*), the fifth print sheet P5 as fed up is being printed on the front side, which follows the print sheet p2 now being subjected after the printing on the rear side to a transfer at the printing transfer speed Vg, which still follows the fourth print sheet P4 now being subjected after the printing on the rear side to a transfer at the printing transfer speed Vg. The print sheet P4 follows the first print sheet p1 now being discharged after the printing on the rear side. At the register Rg, the third print sheet P3 as switched back is transferred. As illustrated in FIG. 9(*a*) and FIG. 9(*b*), respective print sheets are spaced at an equal interval to transfer in the constant speed section L1, but they are spaced at unequal intervals to travel else than the constant speed section L1 for acceleration or deceleration.

3. Schedule for Duplex Printing

There will be described a print schedule for duplex printing. The printing apparatus 100 is adapted to work, before discharging a preceding print sheet, to feed a subsequent print sheet as described. Accordingly, for instance, after a printing on the front side of a first print sheet, the first print sheet is reversed in a circulating transfer for a printing on the rear side of the first print sheet, before which there can be a second print sheet fed and printed on the front side. In the example shown in FIG. 9, the first print sheet as printed on the rear side is discharged after the fifth print sheet is fed. And, between the first and the second, the fourth print sheet is transferred, and between the second and the third, the fifth print sheet is transferred. Such being the case, to enable circulation of a plurality of print sheets, it is required to schedule how to order respective sides to be printed in duplex printing.

Figure 10:
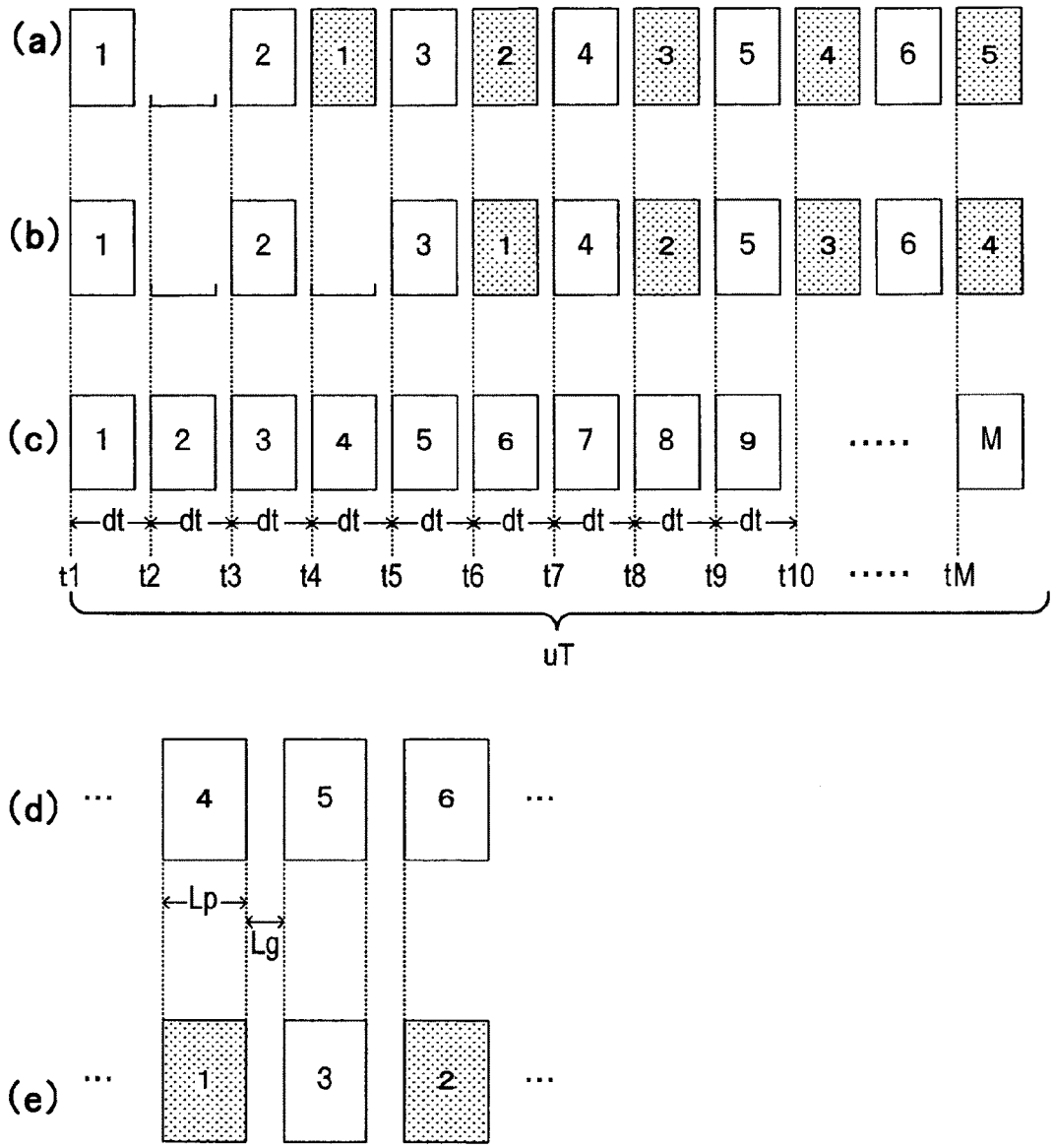
FIGS. 10(*a*) to (*e*) are explanatory diagrams of print schedules for duplex printing.

For the order of printing to enable circulation of a plurality of print sheets, there are alternate shifts being made to print the front side of a print sheet fed anew and the rear side of a print sheet subjected to a circulatory transfer, allowing for an enhanced output (see, e.g., Japanese Patent Application Laid-Open Publication No. 2001-282050, paragraphs "0070" to "0072"). For instance, for N=3, that is, for circulation of three print sheets, as illustrated in FIG. 10(*a*), there comes first a printing on the front side of a first print sheet, which is followed, after a spacing of time corresponding to a printing of one side, by a printing on the front side of a second print sheet, which is followed by a printing on the rear side of the first print sheet circulated by transfer. Then, there comes a printing on the front side of a third print sheet, and next thereto, a printing on the rear side of the second print sheet. This is likewise followed by a sequence of alternate shifts made to print the front side of a print sheet fed anew and the rear side of a print sheet circulated by transfer. It however is provided that, about the end of printing, the completion of feeding new print sheet is followed consecutively twice by a printing on the rear side of a print sheet circulated by transfer, with a spacing of time in between corresponding to a printing of one side, to finish the printing. It is noted that in the figure each print sheet to be printed on the front side is indicated by a white background, and each print sheet to be printed on the rear side is hatched.

Further, for N=5, that is, for circulation of five print sheets, as illustrated in FIG. 10(*b*), there comes first a printing on the front side of a first print sheet, which is followed, after a spacing of time corresponding to a printing of one side, by a printing on the front side of a second print sheet, which is followed, after another spacing of time corresponding to a printing of one side, by a printing on the front side of a third print sheet, which is followed by a printing on the rear side of the first print sheet circulated by transfer. Then, there comes a printing on the front side of a fourth print sheet, and next thereto, a printing on the rear side of the second print sheet circulated by transfer. This is likewise followed by a sequence of alternate shifts made to print the front side of a print sheet fed anew and the rear side of a print sheet circulated by transfer. It however is provided that, about the end of printing, the completion of feeding new print sheet is followed consecutively thrice by a printing on the rear side of a print sheet circulated by transfer, respectively with a spacing of time in between corresponding to a printing of one side, to finish the printing.

And now, as illustrated in FIG. 10(*c*), it is supposed that the printing apparatus 100 be adapted for the ability to work in single-side printing to print, for instance, one-sides of M sheets within a given interval of time uT. Then, a time dt is defined as an interval from initiation of a print on a first print sheet to initiation of a print on a second print sheet. For single-side printing in which print sheets can be fed in turn, the printing apparatus 100 is allowed for a facilitated execution of printing with a maximal output of the printing mechanism. That is, the printing mechanism can do execute transfer of print sheets with a printable printing speed and sheet spacing, so far as a required print quality or such is ensured. Referring now to FIG. 10(*d*), designated at Lg is a distance as the spacing between sheets in single-side printing. As the print sheets have a length Lp in the transfer direction, it so follows that Lp+Lg represents a distance per print sheet with the sheet spacing inclusive.

Now, referring to FIG. 10(*c*), the printing apparatus 100 has an output of print time dt per unit print sheet in single-side printing. If the same output as that, i.e., the print time dt per one side be achieved in duplex printing, it will constitute a maximized output in implementation of duplex printing. It however is provided that duplex printing undergoes, near the start and the end, a section of time including consecutive intervals for front side printing and a section of time including consecutive intervals for rear side printing, respectively having empty intervals in terms of print time dt corresponding to one side of print sheet, and essentially focused to achieve a maximal output is that section of time which covers a sequence of alternate shifts made between front side printing and rear side printing. This time section is referred to as a normal state.

To realize this output, the printing apparatus 100 may well do, for N=3, as illustrated in FIG. 10(*a*), with a circulation of print sheet within a 3×dt interval, as it can do, for instance, with initiation of print on the front side of a first print sheet at a time t1, and initiation of print on the rear side of that print sheet at a time t4 after circulation. Further, it may well do, for N=5, as illustrated in FIG. 10(*b*), with a circulation of print sheet within a 5×dt interval, as it can do, for instance, with initiation of print on the front side of a first print sheet at a time t1, and initiation of print on the rear side of this print sheet at a time t6 after circulation. In other words, it may well do, for a circulating sheet number N, with a circulation of print sheet within an N×dt interval.

For one side of print sheet, the print time dt is a sum of print sheet width Lp and sheet spacing Lg divided by a sheet transfer speed, while the sheet transfer speed when printing equals Vg, whether single-side printing or duplex printing, and for a duplex printing to be performed with the same output as the single-side printing on a one-side basis, the duplex printing should have a sheet spacing equivalent to the sheet spacing Lg in single-side printing. It will be seen from the foregoing that, for the duplex printing to be performed with the same output as the single-side printing on a one-side basis, the circulatory transfer speed Vr may well be set for a possible circulation of print sheet P within a time interval of N×(Lp+Lg)/Vg.

4. Calculation Method of Circulatory Transfer Speed

There will be described a method of calculating the circulatory transfer speed Vr. For the circulating transfer route including sections such as constant speed sections, and deceleration and acceleration sections as described, there will be derived expressions by sections. The constant speed section L1 is referred to as a constant-speed printing transfer section, and the rest covering from constant speed section L2 to deceleration section L6 is referred to as a variable-speed circulatory transfer section.

Figure 11:
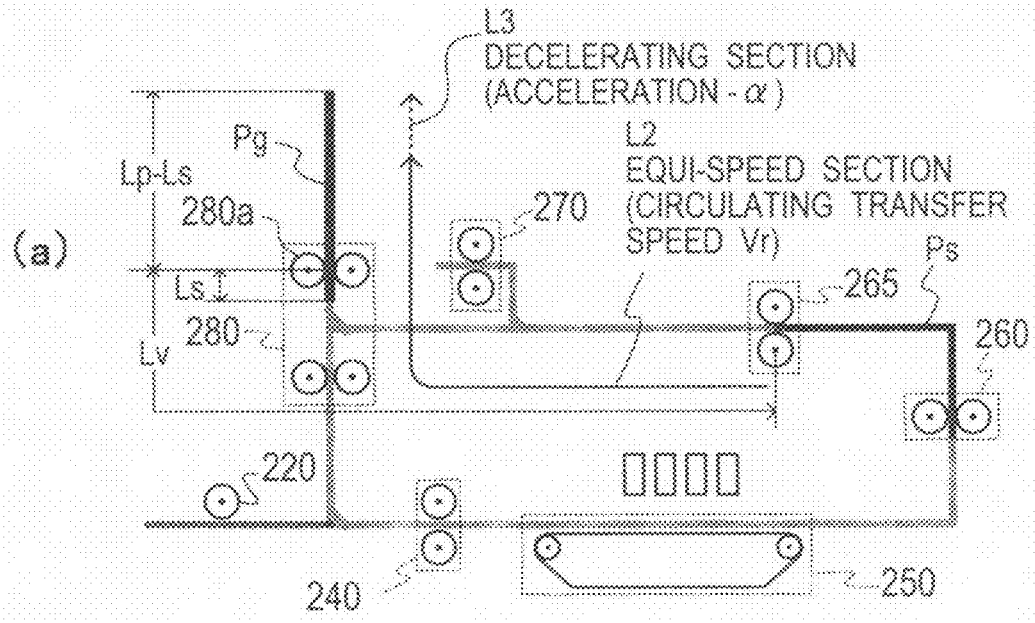
FIGS. 11(*a*) and (*b*) are explanatory diagrams of sheet transfer in a variable speed section of circulatory transfer.
Figure 11:
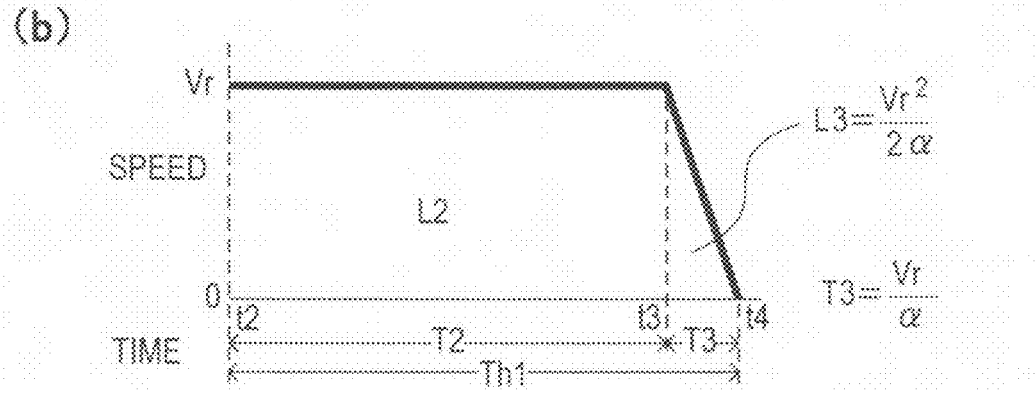

Now focused is a subsection of the variable-speed circulatory transfer section that ranges up to a pause for switchback. FIGS. 11(*a*) and 11(*b*) illustrate, as a time Th1 to be determined, an interval ranging from a point of time when a leading end of a print sheet P has arrived (as a print sheet Ps in the figure) at the second top transfer drive 265's drive rollers, through the constant speed section L2 (as a distance likewise designated by L2) where the print sheet P is transferred at a circulatory transfer speed Vr, and the deceleration section L3 (as a distance likewise designated by L3) where it is decelerated by an acceleration α, to a point of time when it stops (as a print sheet Pg in the figure) to provide for switchback. It is noted that the constant speed section L2 as well as the deceleration section L3 is variable in accordance with the transfer-directional width Lp that depends on the size of print sheet, and the stop position of print sheet (as a position at the distance Ls from the drive rollers 280*a*).

Here, at the constant speed section L2, the print sheet P has a transfer time designated by T2, and at the deceleration section L3, the print sheet P has a transfer time designated by T3. As will be seen from FIG. 11(*a*), there is a total transfer distance L2+L3, which evals Lv+Lp−Ls, accordingly the distance of constant speed section L2 is given, such that

[Math 1]

$$L2=Lv+Lp-Ls-L3 \quad (1)$$

The transfer time T2 is a necessary time for the print sheet P to travel the distance L2 at a circulatory transfer speed Vr, such that

[Math 2]

$$T2=L2/Vr. \tag{2}$$

Further, the transfer time T3 is a time the print sheet P will take when decelerated from the circulatory transfer speed Vr at an acceleration α till it stops, and the distance L3 is a distance the print sheet P then travels, such that

[Math 3]

$$T3=Vr/\alpha, \tag{3}$$

[Math 4]

$$L3=Vr^2/2\alpha. \tag{4}$$

From above, the time Th1 is given, such that

[Math 5]

$$\begin{aligned} Th1 &= T2 + T3 \\ &= L2/Vr + T3 \\ &= (Lv + Lp - Ls - Vr^2/2\alpha)/Vr + Vr/\alpha. \end{aligned} \tag{5}$$

The time Th1 is described as the formula given above.

Figure 12:
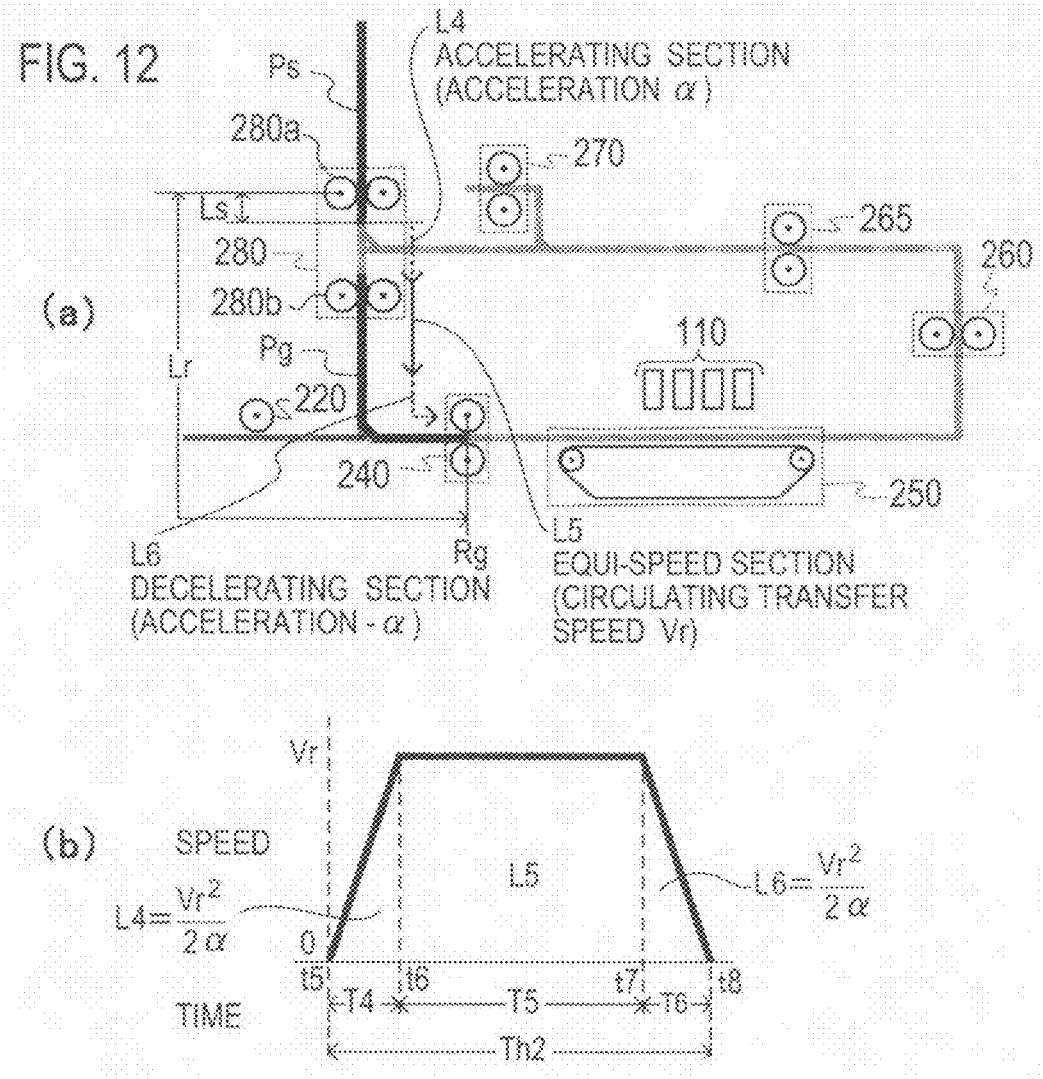
FIGS. 12(*a*) and (*b*) are explanatory diagrams of sheet transfer in a variable speed section of circulatory transfer.

FIGS. 12(*a*) and 12(*b*) illustrate, as a time Th2 to be determined, an interval ranging from a point of time when the print sheet P (as the print sheet Ps in the figure) that has been put to a pause for switchback restarts traveling by transfer at an acceleration a in the acceleration section L4 (as a distance likewise designated by L4), through the constant speed section L5 (as a distance likewise designated by L5) where the print sheet P is transferred at a circulatory transfer speed Vr, and the deceleration section L6 (as a distance likewise designated by L6) where it is decelerated by an acceleration α, to a point of time when it stops (as a print sheet Pg in the figure) at the register Rg.

Here, for the acceleration section L4, a transfer time T4 is designated. At the constant speed section L5, the print sheet P has a transfer time T5, and at the deceleration section L6, the print sheet P has a transfer time T6. As will be seen from FIG. 12(*a*), there is a total transfer distance L4+L5+L6, which equals Lr−Ls, while the print sheet P is slacken at the register Rg as illustrated in FIG. 7, so the print sheet P is transferred longer than the total transfer distance Lr−Ls by a slack Lt. Accordingly, the distance of constant speed section L5 is given, such that

[Math 6]

$$L5=Lr-Ls+Lt-L4-L6. \tag{6}$$

The transfer time T5 is a necessary time for the print sheet P to travel the distance L5 at a circulatory transfer speed Vr, such that

[Math 7]

$$T5=L5/Vr. \tag{7}$$

Further, the transfer time T4 is a time the print sheet P will take when accelerated from the zero speed at an acceleration a till it reaches the circulatory transfer speed Vr, and the transfer time T6 is a time the print sheet P will take when decelerated from the circulatory transfer speed Vr at an acceleration α till it stops, such that

[Math 8]

$$T4=T6=Vr/\alpha. \tag{8}$$

The distances L4 and L6 are distances the print sheet P then travels, respectively, such that

[Math 9]

$$L4=L6=Vr^2/2\alpha. \tag{9}$$

From above, the time Th2 is given, such that

[Math 10]

$$\begin{aligned} Th2 &= T4 + T5 + T6 \\ &= T4 + L5/Vr + T6 \\ &= \frac{2Vr}{\alpha} + (Lr - Ls + Lt - Vr^2/\alpha)/Vr. \end{aligned} \tag{10}$$

The time Th2 is described as the formula given above.

Figure 13:
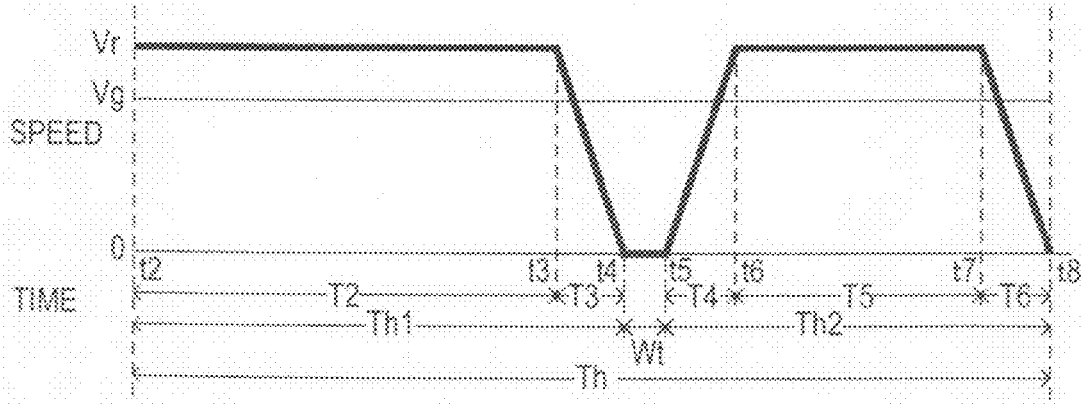
FIG. 13 is a chart of a varying speed of print sheet in a variable speed section of circulatory transfer.

As illustrated in FIG. 13, in the course of switchback, the print sheet P is put to a pause simply for a prescribed time Wt, and the transfer time in the variable-speed circulatory transfer section, that is, the interval of time Th from the point of time when a leading end of the print sheet P has reached the second top transfer drive 265's drive rollers (the print sheet Ps in FIG. 11(*a*)) to the point of time when a trailing end of the print sheet P is stopped (the print sheet Pg in FIG. 12(*a*)) is given, such that

[Math 11]

$$\begin{aligned} Th &= Th1 + Wt + Th2 \\ &= 3\frac{Vr}{\alpha} + \left(Lv + Lr + Lp - 2Ls + Lt - \frac{3Vr^2}{2\alpha}\right)\Big/ Vr + Wt \\ &= \frac{3Vr}{2\alpha} + \frac{Lv + Lr + Lp - 2Ls + Lt}{Vr} + Wt \end{aligned} \tag{11}$$

The interval of time Th is described as the formula given above.

Here, for the interval of time Th, the print sheet P travels a distance at the printing transfer speed Vg, which is designated by Lh, and the distance Lh=Vg×Th is assumed as an equivalent distance (L2+L3+L4+L5+L6) of the variable-speed circulatory transfer section. Then, the constant speed section L1 for a constant speed transfer of print sheet P at the printing transfer speed Vg is added thereto, to determine a total equivalent distance La of the circulating transfer, such that

[Math 12]

$$\begin{aligned} La &= L1 + Lh \\ &= L1 + Vg * Th. \end{aligned} \tag{12}$$

The total equivalent distance La is described as the formula given above.

For a circulating sheet number N, as N print sheets P are transferred in the circulating transfer mute, the distance per print sheet with the sheet spacing Lg inclusive is Lp+Lg for the duplex printing to be performed with same output as the single-side printing on a one-side basis, and the total equivalent distance La of the circulating transfer is given, such that

[Math 13]

$$La=(Lp+Lg)*N. \tag{13}$$

From the expression 12 and the expression 13, it so follows that

[Math 14]

$$(Lp+Lg)*N=L1+Vg*Th. \quad (14)$$

By substituting the expression 11, finally obtained is a quadratic equation of Vr, such that

[Math 15]

$$\frac{3}{2\alpha}Vr^2-\left(\frac{(Lp+Lg)N-L1}{Vg}-Wt\right)Vr+\left(\begin{matrix}Lv+Lr+\\Lp-2Ls+Lt\end{matrix}\right)=0. \quad (15)$$

The circulatory transfer speed Vr can be determined by solving the expression 15 for Vr. It however is essential that Vr should be a real number equivalent to greater than the printing transfer speed Vg.

It is noted that the printing apparatus 100 has fixed values each depending the design being the transfer-directional width of print sheet P as a fixed value Lp depending on the size of print sheet, the distance L1 from the register Rg to the second top transfer drive 265's drive rollers, the distance Lv from the second top transfer drive 265's drive rollers to the drive rollers 280*a* the switchback route drive 280 has at the outermost end on the side of the ante-reverse traveling direction, and the distance Lr from the drive rollers 280*a* the switchback route drive 280 has at the outermost end on the side of the ante-reverse traveling direction to the register Rg.

On the contrary, the acceleration a in the circulating transfer, the sheet spacing Lg for duplex printing to be performed with the same output as the single-side printing on a one-side basis, the trailing end margin Ls for reverse, the pause time Wt for switchback, and the amount of sheet slack Lt have prescribed values that can be changed such as along user's operation, adjustments by service personnel, and firmware update. The circulating sheet number N is determined as a value depending on the total circulatory transfer distance, the transfer-directional width Lp of print sheet, the sheet spacing Lg, and the printing transfer speed Vg. According to the present embodiment, even if any them is changed in value, the expression 15 can be based on to determine a circulatory transfer speed Vr for a duplex printing to be performed with the same output as the single-side printing on a one-side basis. This allows for an enhanced flexibility when setting the circulatory transfer speed.

5. Method of Determining Circulating Sheet Number N, and Method of Determining Circulatory Transfer Speed Vr (First Embodiment Example)

There will be described a method of determining the circulating sheet number N, and a method of determining the circulatory transfer speed Vr, with reference to the flowchart of FIG. 14. For determination of a circulating sheet number N, the print sheet width Lp, the sheet spacing Lg, and the printing transfer speed Vg are first set in accordance with printing conditions set up by user (S101). The print sheet width Lp is set up depending on the size of print sheet. The printing transfer speed Vg is set up in accordance with a maximal droplet number per pixel depending on the kind of print sheet or such, resolution, and the like.

The number of print sheets output per unit time is increased as the sheet spacing Lg gets shorter. In this first example, to achieve a high output, the sheet spacing Lg is set up as a minimal value the printing mechanism can cope with. It is noted that the print sheet width Lp, the sheet spacing Lg, and the printing transfer speed Vg to be set here are for the duplex printing to be performed with the same output as the single-side printing on a one-side basis, and will have the same values for the duplex printing as well, as for the single-side printing.

Next, the total circulating transfer distance is calculated. This distance is not the equivalent distance, but an actual distance. It however is unnecessary to be a severe value, and the trailing end margin Ls for reverse is neglected, to provide a distance as a sum of the print sheet width Lp and a fixed distance (L1+Lv+Lr) depending on the design.

There is a circulating sheet number N provisionally set (S103) from the print sheet width Lp and the sheet spacing Lg determined at the step S101, and the total circulating transfer distance (L1+Lv+Lr+Lp) determined at the step S102. The circulating sheet number N to be provisionally set is such that

[Math 16]

$$N=\frac{L1+Lv+Lr+Lp}{Lp+Lg}. \quad (16)$$

However, for the alternate printing of front side and rear side to be performed during the normal state excluding stages of print start and print end, N is limited to an odd number as it is rounded down in the first example. It is noted that for the provisional setting, fractions may be rounded up.

With N provisionally set, calculation is made to determine a circulatory transfer speed Vr based on the expression 15 (S104). Then, it is determined whether or not the calculated circulatory transfer speed Vr is equal to or greater than the printing transfer speed Vg (S105). This is because the circulatory transfer speed Vr is required to be equal to or greater than the printing transfer speed Vg, to avoid collision of print sheets in the circulating transfer route CR.

As a result of this, if the calculated circulatory transfer speed Vr is not equal to or greater than the printing transfer speed Vg (S105: No), two is subtracted from the provisionally set N to provisionally set a sheet number (odd number) of the provisionally set N minus 2, as a new circulating sheet number, and again calculate a circulatory transfer speed Vr based on the expression 15 (S104). This is because a decreased circulating sheet number N provides a faster a circulatory transfer speed Vr. It is noted that there is a minimum value Vrmin of circulatory transfer speed determined from restrictions or the like in mechanism of drives included in the circulating transfer route CR. If this Vrmin is faster than the printing transfer speed Vg, then at the step S105, the determination of whether or not the calculated circulatory transfer speed Vr is equal to or greater than the printing transfer speed Vg is substituted by a determination of whether or not the calculated circulatory transfer speed Vr has a value equal to or greater than the minimum value Vrmin.

On the other hand, if the calculated circulatory transfer speed Vr is equal to or greater than the printing transfer speed Vg (S105: Yes), the provisionally set sheet number is determined to be N, as a determination for the circulating transfer to be performed at the calculated circulatory transfer speed Vr (S107). It however is noted that more or less time adjustment is possible at the register Rg, so the circulating transfer may be performed at a speed somewhat higher than the circulatory transfer speed Vr.

Figure 15:
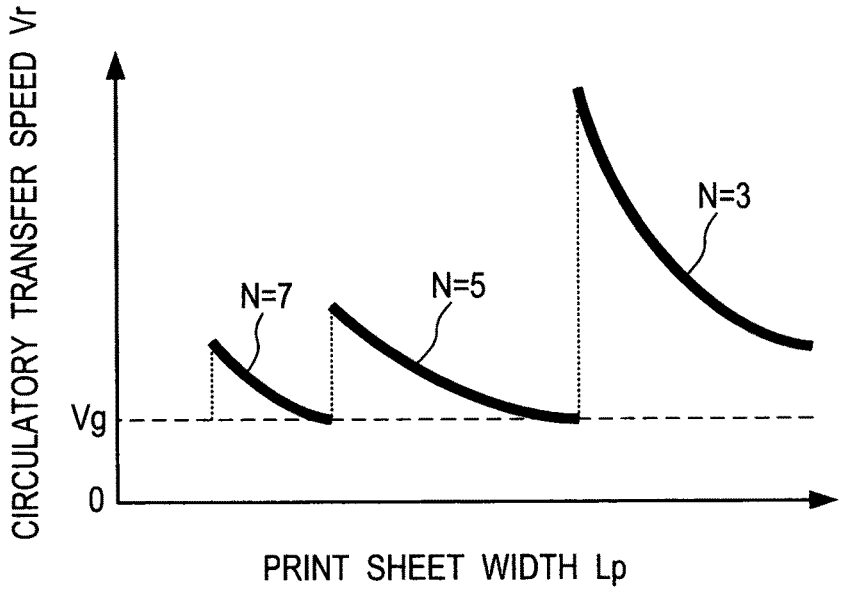
FIG. 15 is a graph illustrating relationships between print sheet widths and circulatory transfer speeds.

FIG. 15 shows relationships among print sheet width Lp, circulating sheet number N, and circulatory transfer speed Vr determined in the above-described procedure, with the printing transfer speed Vg and the sheet spacing Lg fixed. That is, for a print sheet width Lp set up, the circulating sheet number N and the circulatory transfer speed Vr are uniquely determined. As will be seen from this figure, the longer the print sheet width Lp is changed the smaller the circulating sheet number N becomes, and for an identical circulating sheet number N, the longer the print sheet width Lp is changed the slower the circulatory transfer speed Vr becomes. Further, the circulatory transfer speed Vr has a minimal value corresponding to the printing transfer speed Vg.

(Second Embodiment Example)

Description is now made of a second embodiment example. As shown in FIG. 15, the longer the print sheet width Lp is changed the smaller the circulating sheet number N becomes. As the circulating sheet number N gets smaller, the print sheets have to be circulated in a shorter period, and the circulatory transfer speed Vr has to be set faster.

The circulating sheet number N has a physically possible upper limit, which depends on the total circulation transfer distance (L1+Lv+Lr+Lp), print sheet width Lp, etc. Therefore, if the total circulation transfer distance becomes short for the machine housing of printing apparatus 100 made compact in size or the like, the circulating sheet number N may be bound to a small value, when printing a print sheet with a large sheet width Lp.

Figure 14:
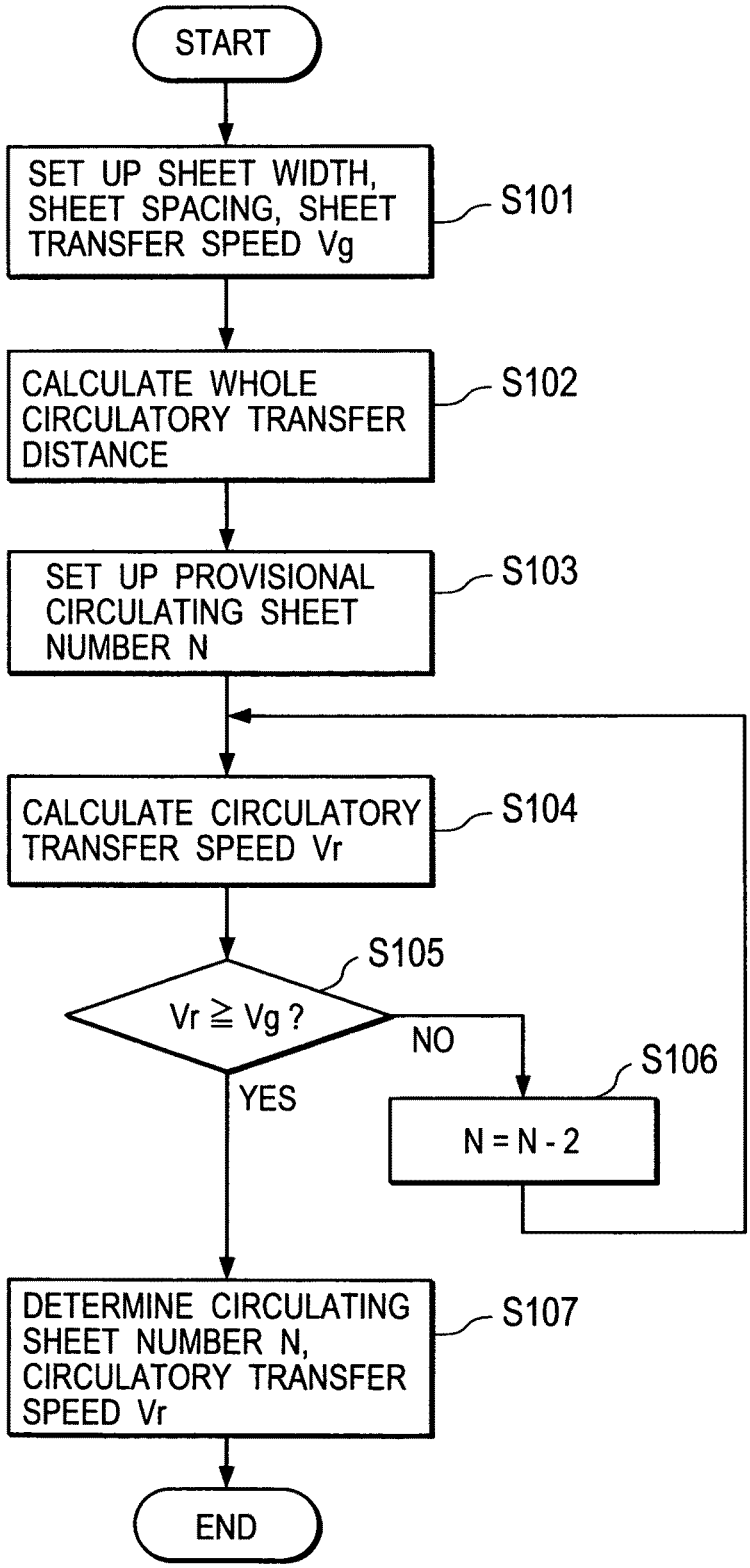
FIG. 14 is an explanatory flowchart of a method of determining a circulating sheet number N and a circulatory transfer speed Vr for a duplex printing according to a first example of embodiment.

The circulatory transfer speed Vr is to be set faster with a smaller circulating sheet number N, and the circulatory transfer speed Vr determined in accordance with the flowchart of FIG. 14 may exceed a certified transfer speed of drive mechanisms in the variable speed circulating transfer section (constant speed section L2 to deceleration section L6). In a situation with anxieties of such an issue, preferably the circulatory transfer speed Vr should be determined within the certified transfer speed of drive mechanisms, even if the output is reduced. In this respect, as a second embodiment example, there will be described a case in which the circulatory transfer speed Vr has a preset maximum value Vrmax. In this case also, the printing apparatus 100 may well be operated for a duplex printing with a maximal output.

Figure 16:
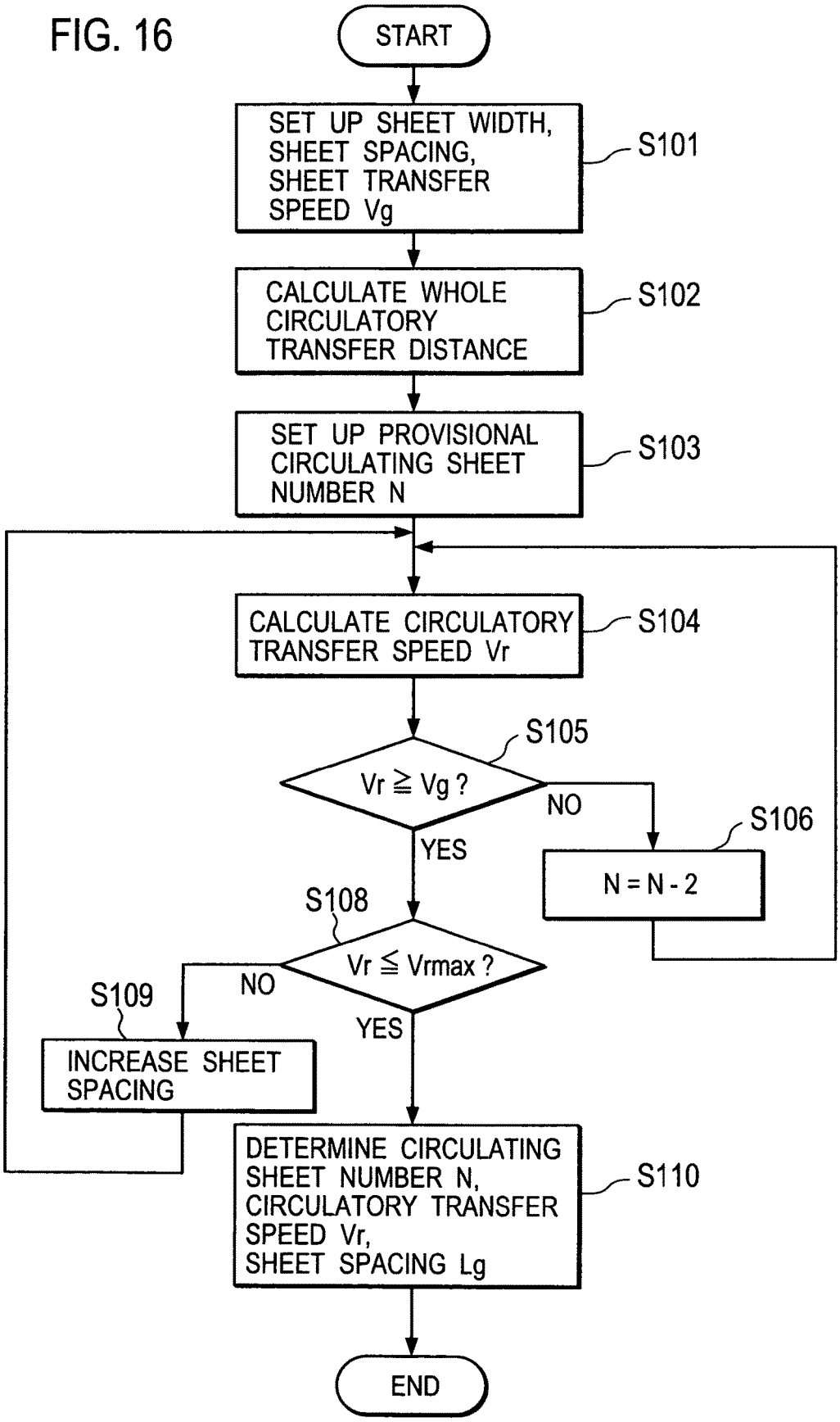
FIG. 16 is an explanatory flowchart of a method of determining a circulating sheet number N and a circulatory transfer speed Vr for a duplex printing according to a second example of embodiment.

FIG. 16 is an explanatory flowchart of a method of determining a circulating sheet number N and a circulatory transfer speed Vr for duplex printing according to the second embodiment example. There processes substantially similar to the flowchart shown in FIG. 14 in the first embodiment example, which are designated by like reference characters to eliminate redundancy. Relative to the flowchart shown in FIG. 14, there is a difference such that with a condition met for a circulatory transfer speed Vr calculated at a step S105 as a value to be equal to or greater a printing transfer speed Vg, a determination is made of whether or not the calculated circulatory transfer speed Vr meets a condition that it should be equal to or smaller than the maximum value Vrmax (S108). As a result of this, if this condition is met (S108: Yes), then a provisionally set sheet number is determined as an N like the flowchart shown in FIG. 14, with a determination for a circulating transfer to be performed at the calculated circulatory transfer speed Vr (S110).

On the other hand, unless (S108: No) the condition is met for the calculated circulatory transfer speed Vr is equal to or smaller than the maximum value Vrmax, then the sheet spacing Lg is increased by a predetermined amount (S109), and a calculation is again made to determine a circulatory transfer speed Vr (S104). As shown in FIG. 15, for an identical circulating sheet number N, the longer the print sheet width Lp is changed the slower the circulatory transfer speed Vr becomes. Therefore, even if the sheet size is unchangeable, the sheet spacing Lg can be increased to thereby make the circulatory transfer speed Vr slower. Accordingly, in the second embodiment example, the sheet spacing Lg is incremented by the predetermined amount to repeat re-calculation of circulatory transfer speed Vr, until a re-calculated circulatory transfer speed Vr reaches the maximum value Vrmax. As the sheet spacing Lg is increased, the number of print sheets output per unit time is decreased, with a resultant reduction in output.

As a result of this, if the re-calculated circulatory transfer speed Vr is equal to or smaller than the maximum value Vrmax, the sheet spacing Lg at the time of calculation is determined to be a sheet spacing Lg when printing, and a provisionally set sheet number is determined to be the N, with a determination for a circulating transfer to be performed at the calculated circulatory transfer speed Vr (S110). Therefore, even if the circulatory transfer speed Vr has a predetermined maximum value Vrmax, the printing apparatus 100 may well be operated for a duplex printing with a maximal output as possible. Further, even if a maximum output is unable to be achieved by provision of the maximum value Vrmax of circulatory transfer speed Vr, the reduction of output can be suppressed minimum.

Figure 17:
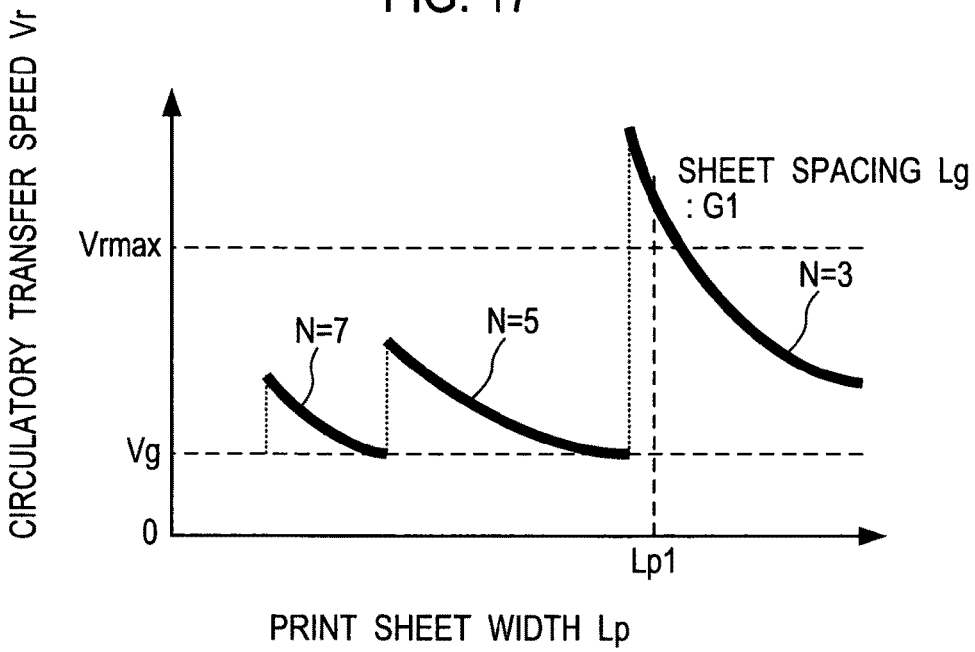
FIGS. 17(*a*) and (*b*) are graphs illustrating relationships between print sheet widths and circulatory transfer speeds.
Figure 17:
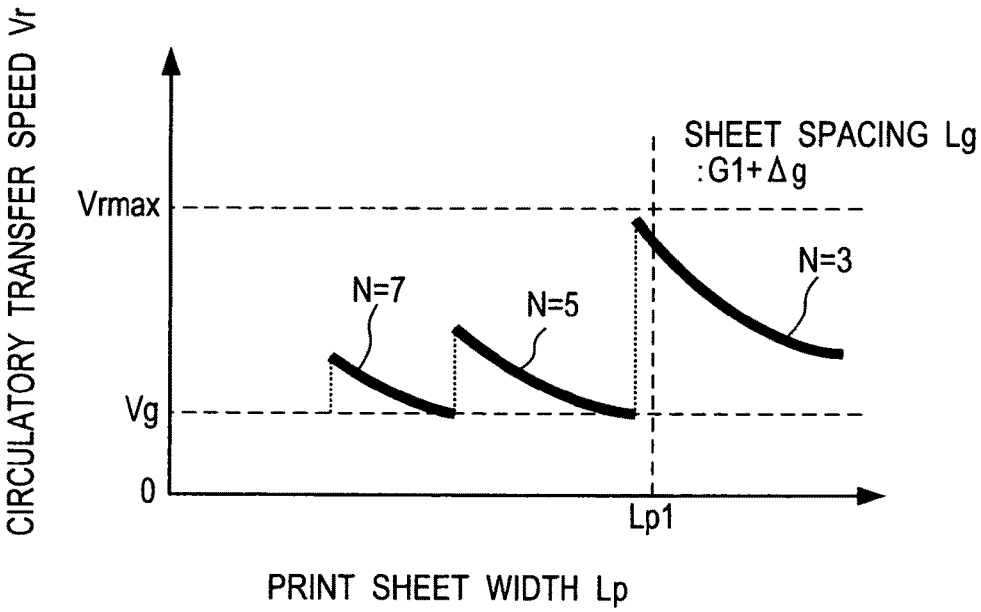

For instance, assuming a case in which as shown in FIG. 17(*a*) for a sheet spacing G1, a circulatory transfer speed Vr calculated when the print sheet width is Lp11 has exceeded a maximum value Vrmax, FIG. 17(*b*) shows a sequence of re-calculations of circulatory transfer speed Vr with an increased sheet spacing up to a sheet spacing of G1+Δg, where the circulatory transfer speed Vr has become smaller than the maximum value Vrmax.

It is noted that unless (S108: No) the condition is met for the circulatory transfer speed Vr is equal to or smaller than the maximum value Vrmax, then the maximum value Vrmax may be employed as a circulatory transfer speed Vr, permitting a sheet spacing Lg to be directly calculated from the expression 15. This case eliminates the need of the process of re-calculating a circulatory transfer speed Yr.

In cases with possible requests for a high speed as a circulatory transfer speed Vr from restrictions such as the size of machine housing, there may be requests for a drive mechanism with a motor with a wide speed range. However, such a motor is expensive in general, and employment of a motor with a wide speed range invites a higher cost. In cases with possible requests for a high speed as a circulatory transfer speed Vr from restrictions such as the size of machine housing, the second embodiment example permits the reduction of output to be minimized, while preventing the cost from being increased.

(Third Embodiment Example)

Description is now made of a third embodiment example. In the foregoing embodiment examples, along with the setting of a circulating sheet number N, the expression 16 is based on to set up a provisional value of N, and this N is employed to calculate a circulatory transfer speed Vr. Then, if the calculated circulatory transfer speed Vr is smaller than a printing transfer speed Vg (S105: No), the value of N is decreased to thereby set the circulatory transfer speed Vr to be equal to or greater than the printing transfer speed Vg.

There is a case permitting the circulating sheet number N to be increased with a decreased circulatory transfer speed Vr. That is, there is a case in which the duplex printing can be performed with a greater circulating sheet number than N set up in the procedure above. This can be judged by substituting, into the expression 15, a value N1 (N1=N+2) greater than N set up in the procedure above to obtain a circulatory transfer speed Vr1, to determine whether or not this value is equal to or greater than a printing transfer speed Vg.

If the circulatory transfer speed Vr1 corresponding to N1 has a value equal to or greater than the printing transfer speed Vg, then there are alternatives of N and N1 either selective as a circulating sheet number. In such a case, according to the third embodiment example, the user is allowed to option which circulating sheet number is to be used Namely, between the circulating sheet number N and the circulating sheet number N1 (N<N1), there is a difference of printing transfer speed, and the circulatory transfer speed Vr is faster than the circulatory transfer speed Vr1. Accordingly, for the circulating sheet number N+2, the driving for transfer has a smaller processing sound than the circulating sheet number N, and the load on drive system is reduced, as well.

Further, between the circulating sheet number N and the circulating sheet number N1, also the printing schedule for duplex printing is different. For instance, letting N=3 and N1=5, the printing schedule for N=3 proceeds as illustrated in FIG. 10(*a*), and the printing schedule for N1=5, as illustrated in FIG. 10(*b*). As will be derived from FIG. 10(*a*) and FIG. 10(*b*), when N=3, the printing goes to an end earlier by two one-sides of sheet than when N1=5, while the output in normal state is alike.

From this, when with the circulating sheet number N1, the processing sound is smaller than when with the circulating sheet number N, and the printing comes to an end with a little delay. Therefore, user may select a circulating sheet number N set up in the procedure described, when wanting a print time to be short if only a little, but may select a greater circulating sheet number N1 than the circulating sheet number N, when wanting a sound level to be low if only a little.

Figure 18:
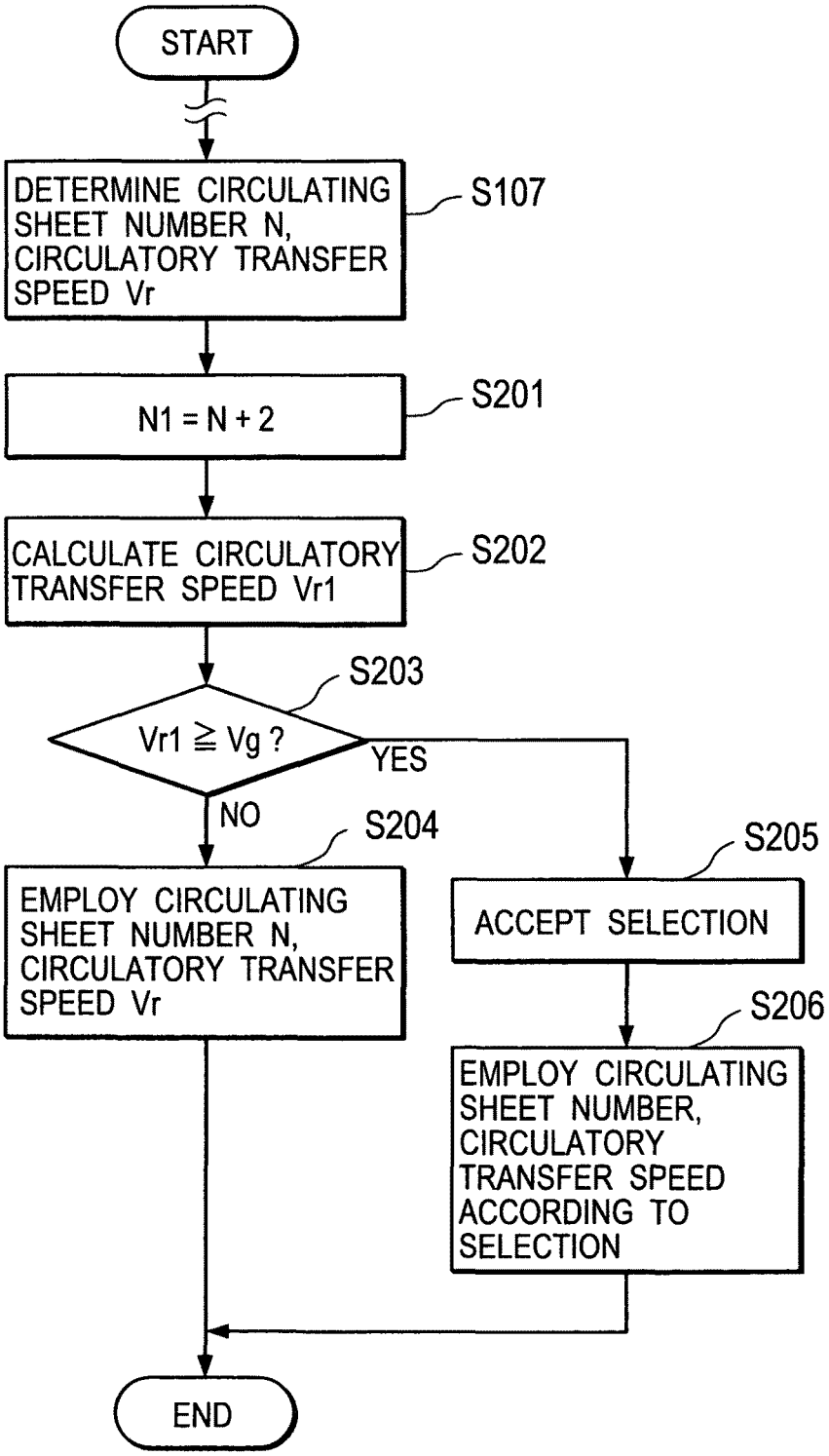
FIG. 18 is an explanatory flowchart of process of a printing apparatus according to a third example of embodiment.

In this respect, the third embodiment example includes the following process steps. FIG. 18 is a flowchart of steps in a process of the printing apparatus 100 according to the third embodiment example. In this process, first, there is performed a sequence of steps (not shown) identical to the process from the step S101 to the step S107 in FIG. 14, to thereby determine a circulating sheet number N and a circulatory transfer speed Vr.

As the circulating sheet number N is determined, N1 is set up such that N1=N+2 (S201). Thus set N1 is used to calculate a circulatory transfer speed Vr1 in accordance with the expression 15 (S202). After calculation of the circulatory transfer speed Vr1, it is determined whether or not the circulatory transfer speed Vr1 is equal to or greater than the printing transfer speed Vg (S203).

As a result, unless the calculated circulatory transfer speed Vr1 is equal to or greater than the printing transfer speed Vg (S203: No), there is no choice but to employ the circulating sheet number N and the circulatory transfer speed Vr determined at the step S107 to enter a duplex printing (S204).

On the other hand, if the calculated circulatory transfer speed Vr1 is equal to or greater than the printing transfer speed Vg (S203: Yes), there are alternatives of N and N1 either selective as a circulating sheet number. Therefore, user's selection is accepted (S205). This acceptance of selection may be implemented as a setting of operation mode at the printing condition setter 310, for instance. Along therewith, the circulating sheet number N may be handled as a normal mode, and the circulating sheet number N1, as a quiet mode, for instance. Further, there may be N2 deduced such that N2=N1+2, to use for calculation of a circulatory transfer speed Vr2, to determine whether or not this Vr2 is equal to or greater than the printing transfer speed Vg.

Then, the accepted user's selection is based on to employ one of N and N1 as a circulating sheet number, to make a duplex printing at a circulatory transfer speed corresponding thereto (S206). Such being the case, according to the third embodiment example, user's selection is accepted as a choice from among a plurality of alternative circulating sheet numbers for a duplex printing to be performed with the same output as the single-side printing on a one-side basis. User is thereby allowed to use both a circulating sheet number enabled with a shorter print time and a circulating sheet number enabled with a smaller processing sound, as the situation demands.

Industrial Applicability

As will be seen from the foregoing description, according to the present invention, for a duplex printing, there is a circulation of sheet performed for transfer from a register to the register by a time interval of N×(Lp+Lg)/Vg, where N is a circulating sheet number defining an order of printing, Lp is a sheet width in a sheet transfer direction, Lg is a sheet spacing, and Vg is a sheet transfer speed, whereby the duplex printing can be made with an output of half an output sheet number of a single-side printing in terms of the number of output sheets per unit time in a normal state. Further, there is use of a combination of accelerations applied to deceleration and acceleration sections, the sheet width Lp, the sheet spacing Lg, and the transfer speed Vg when printing, to calculate a transfer speed Vr allowing for a setting of transfer speed with an enhanced flexibility.

The invention claimed is:

1. A duplex printing apparatus provided with a circulating transfer route including a sheet reversing path, and configured to transfer a sheet printed on a front side thereof in a circulating manner along the circulating transfer route, reversing front to rear, to make a print on a rear side thereof in an interleaf control method, the duplex printing apparatus comprising:

a printer adapted for image formation onto a sheet of a sheet width Lp in a transfer direction, with a sheet spacing Lg and a printing transfer speed Vg;

a constant speed transferrer adapted for constant speed transfer of sheet at the printing transfer speed Vg from a register for sheet registration via the printer to a prescribed speed change position in the circulating transfer route;

a variable speed transferrer adapted for transfer of sheet from the speed change position via the sheet reversing path to the register, and a transfer controller configured to control transfer speeds of sheet in the variable speed transferrer, the variable speed transferrer comprising sections configured for sheet transfer, including a combination of a deceleration section and an acceleration section adapted for sheet reversal at the sheet reversing path, and a constant speed section adapted for transfer at a transfer speed Vr, the transfer controller being adapted to, in the case of two or more sheets:

determine a circulating sheet number N employing a combination of sheet width Lp, spacing between sheets Lg and a total circulating transfer distance, execute a calculation of transfer speed Vr employing a combination of the circulating sheet number N, sheet width Lp, sheet spacing Lg, printing transfer speed Vg, and accelerations to be applied at the deceleration section and the acceleration section, to transfer a sheet from the register in the circulating manner to the register within a time interval of N×(Lp+Lg)/Vg, and compare the calculated transfer speed Vr and the printing transfer speed Vg, and to set the transfer speed Vr to be the printing transfer speed Vg or more by reducing the circulation sheet number N and recalculating the transfer speed Vr, if the transfer speed Vr is less than the printing transfer speed.

2. The duplex printing apparatus according to claim 1, wherein the variable speed transferrer further includes, as a section configured for sheet transfer, a second deceleration section adapted for a pause of a sheet at the register, and the transfer controller is adapted to execute a calculation of transfer speed Vr further employing an acceleration to be applied at the second deceleration section.

3. The duplex printing apparatus according to claim 2, wherein the variable speed transferrer is adapted to provide a sheet at a pause at the register with an amount of slack Lt for correction of oblique position of the sheet, and the transfer controller is adapted to execute a calculation of transfer speed Vr further employing the amount of slack Lt.

4. The duplex printing apparatus according to claim 1, wherein the variable speed transferrer is adapted to have a time interval for sheet transfer including a pause time Wt for sheet reversal at the sheet reversing path, and the transfer controller is adapted to execute a calculation of transfer speed Vr further employing the pause time Wt.

5. The duplex printing apparatus according to claim 4, wherein the variable speed transferrer comprises a reverse drive roller configured to reverse a sheet at the sheet reversing path, and the transfer controller is adapted to execute a calculation of transfer speed Vr further employing a trailing end margin Ls between a position of the reverse drive roller and a position of an end of the sheet at an end of the reverse drive roller in the pause time for sheet reversal.

6. The duplex printing apparatus according to claim 1, wherein the transfer controller is further adapted to compare the calculated transfer speed Vr to a permissible maximum speed Vrmax of the variable speed transferrer, and to set the transfer speed Vr to be the permissible maximum speed Vrmax of the variable speed transferrer or less by increasing the sheet spacing Lg and recalculating the transfer speed Vr if the calculated transfer speed Vr is greater than the permissible maximum speed Vrmax.

7. The duplex printing apparatus according to claim 1, wherein the transfer controller is adapted to compare a plurality of combinations of circulating sheet number N and transfer speed Vr, with each combination affording the transfer speed Vr to be set to the printing transfer speed Vg or more, and determine a combination of circulating sheet number N and transfer speed Vr in accordance with a user's selection.

8. The duplex printing apparatus according to claim 1, wherein the constant speed transferrer comprises one or more drive rollers configured for sheet transfer, including at least one drive roller nearest to the speed change position and configured with a one-way clutch structure with respect to a sheet transfer direction.

9. The duplex printing apparatus according to claim 1, wherein the circulating transfer route has the printer positioned thereto at a longer distance from the speed change position than a transfer-directional width of a sheet of a predetermined maximal certified size.

* * * * *